US008902550B2

(12) United States Patent
Matsuo et al.

(10) Patent No.: US 8,902,550 B2
(45) Date of Patent: Dec. 2, 2014

(54) DIRECT-CURRENT SWITCH

(75) Inventors: Hirofumi Matsuo, Nagasaki (JP); Kazuaki Mino, Hino (JP); Hiroyuki Ota, Matumoto (JP); Toru Hosen, Matumoto (JP); Hironobu Shiroyama, Matumoto (JP)

(73) Assignees: Fuji Electric Co., Ltd., Kawasaki (JP); Hirofumi Matsuo, Nagasaki (JP)

( * ) Notice: Subject to any disclaimer, the term of this patent is extended or adjusted under 35 U.S.C. 154(b) by 630 days.

(21) Appl. No.: 13/182,907

(22) Filed: Jul. 14, 2011

(65) Prior Publication Data

US 2012/0018404 A1 Jan. 26, 2012

(30) Foreign Application Priority Data

Jul. 23, 2010 (JP) ..... 2010-166553

(51) Int. Cl.
*H01H 9/38* (2006.01)
*H01H 9/54* (2006.01)
*H01H 33/59* (2006.01)

(52) U.S. Cl.
CPC ..... *H01H 9/542* (2013.01); *H01H 33/596* (2013.01); *H01H 9/548* (2013.01)
USPC ..... 361/13

(58) Field of Classification Search
CPC ..... H01H 9/54; H01H 9/542; H01H 9/548; H01H 33/596; H01H 2009/545
USPC ..... 361/13
See application file for complete search history.

(56) References Cited

U.S. PATENT DOCUMENTS

| | | | | |
|---|---|---|---|---|
| 4,356,525 | A * | 10/1982 | Kornrumpf et al. | 361/4 |
| 4,389,691 | A * | 6/1983 | Hancock | 361/8 |
| 4,855,612 | A * | 8/1989 | Koga et al. | 307/140 |
| 4,956,738 | A * | 9/1990 | Defosse et al. | 361/8 |
| 4,992,904 | A | 2/1991 | Spencer et al. | |
| 5,132,865 | A | 7/1992 | Mertz et al. | |
| 5,488,530 | A | 1/1996 | De Jong | |
| 5,793,586 | A | 8/1998 | Rockot et al. | |
| 7,079,363 | B2 * | 7/2006 | Chung | 361/13 |
| 2004/0027734 | A1 * | 2/2004 | Fairfax et al. | 361/2 |
| 2008/0143462 | A1 | 6/2008 | Belisle et al. | |

FOREIGN PATENT DOCUMENTS

| | | |
|---|---|---|
| DE | 1005594 | 4/1957 |
| EP | 0184566 A1 | 6/1986 |

(Continued)

OTHER PUBLICATIONS

Peter J. Theisen et al., "270-V DC Hybrid Switch", IEEE Transactions on Components, Hybrids, and Manufacturing Technology, vol. CHMT-9, No. 1, Mar. 1986, pp. 97-100.

*Primary Examiner* — Jared Fureman
*Assistant Examiner* — Kevin J Comber

(57) ABSTRACT

A miniaturized direct-current switch with which power loss is reduced when establishing continuity of a direct-current path is provided. The direct-current switch includes an electronic open/close switch inserted in a direct-current path along which a direct current flows in order to make the direct-current path an open circuit or a closed circuit, a parallel mechanical open/close switch connected in parallel to the electronic open/close switch, and a switch control circuit that controls the opening or closing time difference mutually between the parallel mechanical open/close switch and the electronic open/close switch, wherein the switch control circuit makes the parallel mechanical open/close switch a closed circuit a predetermined time after the electronic open/close switch has been made a closed circuit.

3 Claims, 14 Drawing Sheets

(56) References Cited

FOREIGN PATENT DOCUMENTS

| | | |
|---|---|---|
| JP | 6-162880 | 6/1994 |
| JP | 8-106839 | 4/1996 |
| JP | 9-82184 | 3/1997 |
| JP | 10-302584 | 11/1998 |
| JP | 2003-338239 | 11/2003 |
| JP | 2007-213842 | 8/2007 |
| JP | 2009-206066 | 9/2009 |

* cited by examiner

FIG.2A CONTROL SWITCH 17

FIG.2B ELECTRONIC OPEN/CLOSE SWITCH 15

FIG.2C PARALLEL MECHANICAL OPEN/CLOSE SWITCH 16

FIG.5A CONTROL SWITCH 17

FIG.5B SERIAL MECHANICAL OPEN/CLOSE SWITCH 161

FIG.5C ELECTRONIC OPEN/CLOSE SWITCH 15

FIG.5D PARALLEL MECHANICAL OPEN/CLOSE SWITCH 16

DIRECT-CURRENT SWITCH

CROSS-REFERENCE TO RELATED APPLICATION

This application is based on and claims priority from the prior Japanese patent Application No. 2010-166553 filed on Jul. 23, 2010, the entire contents of which are incorporated herein by reference.

BACKGROUND

1. Field

The present invention relates to a direct-current switch suitable for making a direct-current path, along which a direct current flows, an open circuit or a closed circuit.

2. Description of the Related Art

To date, alternating-current power has been supplied to general households from an alternating-current utility grid (a commercial power supply) using a synchronous generator. Meanwhile, in recent years, dispersed power sources using photovoltaic power generation, wind power generation, fuel cell power generation, or the like, have attracted attention, and have started to be used in general households. It is often the case that power generated by these dispersed power sources is direct-current power. A direct-current power supply that supplies the aforementioned power from a dispersed power source directly to a general household, office, or the like, is becoming accepted by society.

When supplying direct-current power from a utility grid (a direct-current power source) to a direct-current distribution system (for example, to indoor wiring that carries direct-current power), and using the power, it is necessary to interpose a direct-current switch between the indoor wiring and an electrical instrument (for example, a television receiver), and control whether or not to supply power to the electrical instrument. Herein, characteristics required of the direct-current switch (a switch carrying out an establishment of continuity and a shutting-off of direct-current power) differ greatly from characteristics required of a heretofore known alternating-current switch (a switch carrying out an establishment of continuity and a shutting-off of alternating-current power). The heretofore known alternating-current switch is standardized based on the turning on and off of an electric light illuminated by alternating current. To date, various miniature types have been widely used as the aforementioned alternating-current switch. However, when using this kind of miniature alternating-current switch in "a current path along which a direct current flows" (hereafter referred to as a direct-current path), the amount of current which can be shut off is limited to an extremely small amount. The reason for this is that, unlike with alternating current, there is no time at which direct current becomes zero, meaning that an arc generated when the mechanical contacts of the switch open continues to be generated continuously and without stopping, and an arc current caused by generation of the arc continues to flow. Then, on an arc being once generated, the arc current continues to flow, and it may happen that it is substantially not possible to put the mechanical contacts into an opened condition (a condition in which the switch is shut off). Also, it may happen that a burnout of the contacts occurs due to the heat generated by the arc. Then, a switch that can withstand the heat generated by the arc and enable the contacts to be opened is extremely large. That is, the heretofore known alternating-current switch is not suitable for use in an electrical instrument (for example, a household electrical product) that operates on direct-current power supplied from a direct-current power source.

Therefore, a direct-current switch shown as the related art in FIG. 14 has been proposed (refer to JP-A-2007-213842). The direct-current switch shown in FIG. 14 is suitable for use in a direct-current distribution system 110. A direct-current switch 120*a* has an input terminal A, an input terminal B, an output terminal C, and an output terminal D. The direct-current switch 120*a* includes a mechanical open/close switch 116, an electronic open/close switch 115, a switch control circuit 114 that controls the opening or closing time difference mutually between the mechanical open/close switch 116 and the electronic open/close switch 115, and a control switch 117. Then, the mechanical open/close switch 116 is opened after the electronic open/close switch 115 inserted in series in a bus bar 13 has been opened. By so doing, an arc is prevented from being generated in a condition in which the mechanical open/close switch 116 is opened (the current path is shut off), and it is possible to shut off (open) the current path of direct-current power supplied to a load 130 with a miniature mechanical open/close switch 116.

In the direct-current switch 120*a* disclosed in JP-A-2007-213842, continuity is established in both the mechanical open/close switch 116 and the electronic open/close switch 115 when establishing continuity (closing) of the direct-current path. Herein, it may be that although the contact resistance of the mechanical open/close switch 116 is in the region of, for example, a few mΩ (milliohm), the contact resistance of the electronic open/close switch 115 is in the region of, for example, a few hundred mΩ. For this reason, when the aforementioned direct-current switch establishes continuity (closing) of the current path for a long time, resistance loss (power loss) in the electronic open/close switch 115 cannot be ignored, and heat generation due to the resistance loss cannot be ignored either.

Herein, in order to reduce the contact resistance of the electronic open/close switch 115, a possible solution is to increase the chip size of the electronic open/close switch 115, which is formed from a semiconductor, and reduce the resistance when continuity is established. Also, a possible solution is to reduce the turn-on voltage when continuity is established. Furthermore, with regard to heat generation occurring in the electronic open/close switch 115, while it is not possible to prevent the heat generation itself, it is possible to prevent a rise in temperature of the electronic open/close switch 115 by using a heat sink formed from a material with a high thermal conductivity. However, when increasing the chip size, the cost of the electronic open/close switch 115 increases. Also, when using a heat sink, it is not possible to avoid an increase in size of the direct-current switch.

SUMMARY

Additional aspects and/or advantages will be set forth in part in the description which follows and, in part, will be apparent from the description, or may be learned by practice of the invention.

An object of embodiments of the invention is to provide a miniaturized direct-current switch with which power loss is reduced when establishing continuity (closing) of a direct-current path.

In order to achieve the object, a direct-current switch of one aspect of the invention includes an electronic open/close switch inserted in the direct-current path along which a direct current flows in order to make the direct-current path an open circuit or a closed circuit, a parallel mechanical open/close switch connected in parallel to the electronic open/close switch, and a switch control circuit that controls the opening or closing time difference mutually between the parallel mechanical open/close switch and the electronic open/close switch, wherein the switch control circuit makes the parallel mechanical open/close switch a closed circuit a predetermined time after the electronic open/close switch has been made a closed circuit.

According to embodiments of the invention, by including a mechanical open/close switch, an electronic open/close switch and a switch control circuit that controls the mechanical open/close switch and the electronic open/close switch, it is possible to provide a low-cost and miniaturized direct-current switch with which power loss of the electronic open/close switch is reduced when establishing continuity of (closing) a direct-current path.

BRIEF DESCRIPTION OF THE DRAWINGS

These and/or other aspects and advantages will become apparent and more readily appreciated from the following description of the embodiments, taken in conjunction with the accompanying drawings of which.

DESCRIPTION OF EMBODIMENTS

Figure 1:
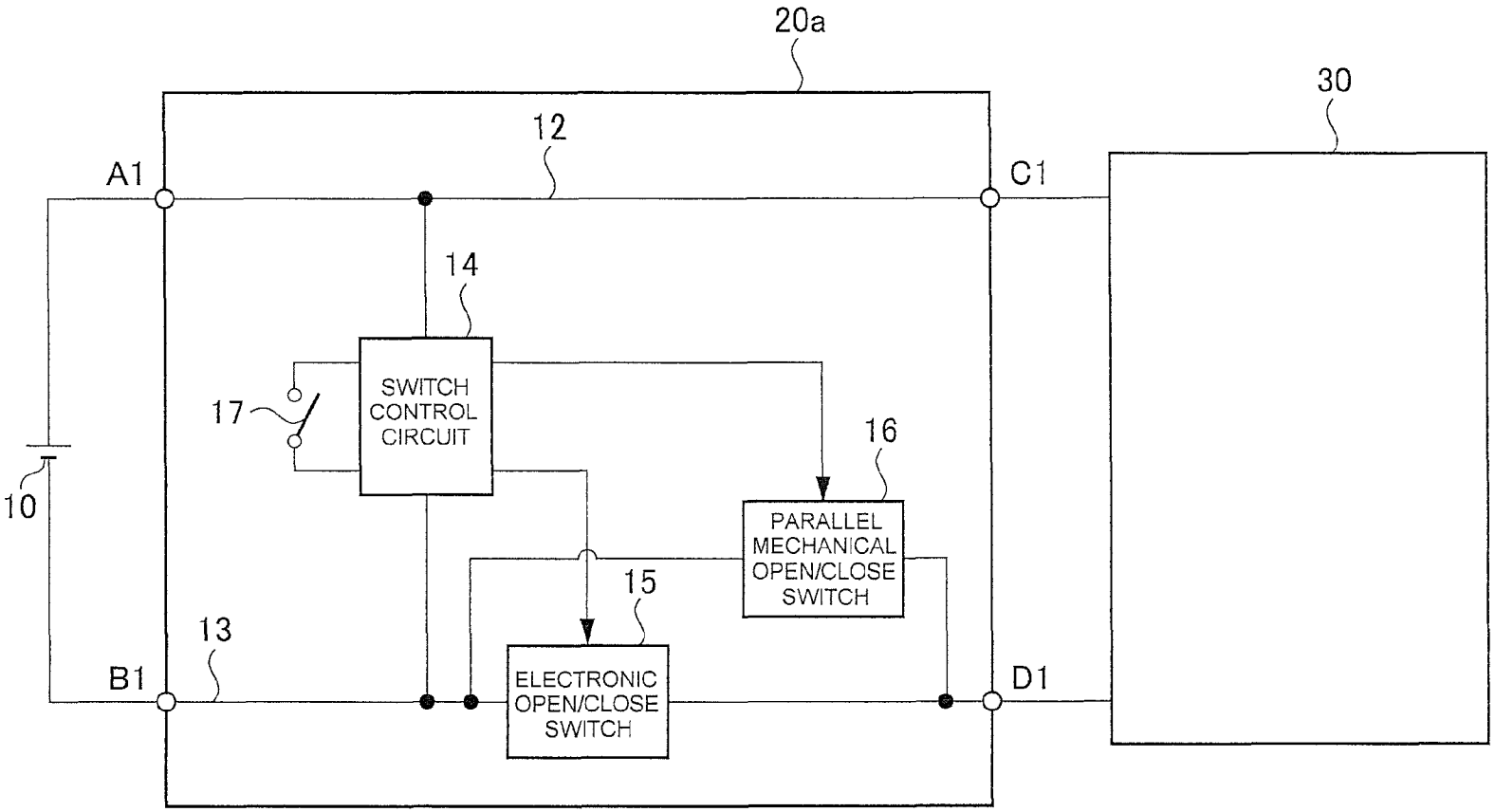
FIG. 1 is a diagram showing a first embodiment.

Hereafter, a description will be given of embodiments of the invention.

A direct-current switch of a first embodiment includes an electronic open/close switch inserted in a direct-current path along which a direct current flows in order to make the direct-current path an open circuit or a closed circuit, a parallel mechanical open/close switch connected in parallel to the electronic open/close switch, and a switch control circuit that controls the opening or closing time difference mutually between the parallel mechanical open/close switch and the electronic open/close switch. Then, the switch control circuit makes the parallel mechanical open/close switch a closed circuit a predetermined time after the electronic open/close switch is made a closed circuit.

A direct-current switch of a second embodiment includes an electronic open/close switch inserted in a direct-current path along which a direct current flows in order to make the direct-current path an open circuit or a closed circuit, a parallel mechanical open/close switch connected in parallel to the electronic open/close switch, a serial mechanical open/close switch connected in series to the electronic open/close switch and parallel mechanical open/close switch, and a switch control circuit that controls the opening or closing time difference mutually among the three switches—the parallel mechanical open/close switch, serial mechanical open/close switch, and the electronic open/close switch. Then, when making the direct-current path along which a direct current flows a closed circuit, the switch control circuit makes the electronic open/close switch a closed circuit a predetermined time after the serial mechanical open/close switch has been made a closed circuit, and lastly makes the parallel mechanical open/close switch a closed circuit. Also, when making the direct-current path along which a direct current flows an open circuit, the switch control circuit makes the electronic open/close switch an open circuit a predetermined time after the parallel mechanical open/close switch has been made an open circuit, and lastly makes the serial mechanical open/close switch an open circuit.

A direct-current switch of a third embodiment includes an electronic open/close switch inserted in a direct-current path along which a direct current flows in order to make the direct-current path an open circuit or a closed circuit, a serial mechanical open/close switch connected in series to the electronic open/close switch, a parallel mechanical open/close switch connected in parallel to a series connection circuit formed of the electronic open/close switch and the serially connected mechanical open/close switch, and a switch control circuit that controls the opening or closing time difference mutually among the three switches—the parallel mechanical open/close switch, serial mechanical open/close switch, and the electronic open/close switch. Then, when making the direct-current path along which a direct current flows a closed circuit, the switch control circuit makes the electronic open/close switch a closed circuit a predetermined time after the serial mechanical open/close switch has been made a closed circuit, and lastly makes the parallel mechanical open/close switch a closed circuit. Also, when making the direct-current path along which a direct current flows an open circuit, the switch control circuit makes the electronic open/close switch an open circuit a predetermined time after the parallel mechanical open/close switch has been made an open circuit, and lastly makes the serial mechanical open/close switch an open circuit.

A direct-current switch of a modification of the embodiments (hereafter referred to as a modification example of the embodiments) is such that a commutating diode or regenerative diode is added to the direct-current switches of the first to third embodiments, furthermore, to a direct-current switch having only an electronic open/close switch and serial mechanical open/close switch. The addition of a commutating diode solves the problem of how to prevent the occurrence of a counter electromotive force immediately after the direct-current switch is shut off. The addition of a regenerative diode solves the problem of how to carry out regeneration via the direct-current switch of power generated in a motor, which is a load.

Hereafter, a detailed description will be given of the first to third embodiments, and furthermore, of the modification of the embodiments, but as the parallel mechanical open/close switch in the first embodiment, and the parallel mechanical open/close switch and serial mechanical open/close switch in the second and third embodiments, are components of the direct-current switch, and these are also components in the modification example of the embodiments, a description of these mechanical open/close switches will be given first.

The mechanical open/close switch has two contacts formed of a conductive body, the mechanical open/close switch is inserted in a direct-current path, which is a path along which a current flows, and each contact of the mechanical open/close switch is connected to one branch of the direct-current path, which is divided in two. The configuration is such that the direct-current path is formed by the two contacts coming into contact with each other and forming a closed condition, and the direct-current path is shut off by the two contacts separating from each other and forming an open condition.

In the first embodiment and the second embodiment, as a mechanical open/close switch 16, to be described hereafter, is connected in parallel to an electronic open/close switch 15, to be described hereafter, the mechanical open/close switch 16 is also referred to as a parallel mechanical open/close switch 16, clarifying the function thereof. Also, in the third embodiment, as the mechanical open/close switch 16 is connected in parallel to the electronic open/close switch 15, albeit via a mechanical open/close switch 161, it is also referred to as the parallel mechanical open/close switch 16 in the third embodiment.

In the second embodiment, as the mechanical open/close switch 161, being connected in series to the parallel connection circuit of the parallel mechanical open/close switch 16 and the electronic open/close switch 15, is connected in series to at least the electronic open/close switch 15, the mechanical open/close switch 161 is also referred to as a serial mechanical open/close switch 161, clarifying the function thereof. Also, in the third embodiment, as the mechanical open/close switch 161 is connected in series to the electronic open/close switch 15, the mechanical open/close switch 161, in the same way, is also referred to as the serial mechanical open/close switch 161, clarifying the function thereof.

Also, in a direct-current switch of the fourth to seventh modification examples wherein a regenerative circuit is added to the direct-current switch, to be described hereafter, as a mechanical open/close switch 116 functions as a serial mechanical open/close switch, the mechanical open/close switch 116 is also referred to as a serial mechanical open/close switch 116, clarifying the function thereof.

Herein, "parallel" in a parallel mechanical open/close switch means a connection aspect wherein the current is divided into the electronic open/close switch disposed in the direct-current path and the mechanical open/close switch (including a case in which one branch of the divided current is zero). That is, when the electronic open/close switch and mechanical open/close switch are connected in parallel, the resistance value of the electronic open/close switch is larger than the resistance value of the mechanical open/close switch, meaning that a large portion of the current flowing along the direct-current path flows through the mechanical open/close switch. Also, when the electronic open/close switch functions as an element having a constant turn-on voltage (the voltage across the switch when there is continuity), rather than functioning as a resistor, the current flows only through the mechanical open/close switch, whose turn-on voltage is near zero.

Also, "serial" in a serial mechanical open/close switch means a kind of connection aspect wherein the current flowing through the electronic open/close switch disposed in the direct-current path flows through the mechanical open/close switch. That is, when the electronic open/close switch and mechanical open/close switch are connected in series, on one of them being shut off (becoming open), no current flows through the portion of the direct-current path in which the electronic open/close switch and mechanical open/close switch are connected in series. With an electrical instrument in which the installation of a mechanical open/close switch is required by safety standards or the like, the requirement can be met by using this kind of series connection.

First Embodiment

FIG. 1 is a diagram showing the first embodiment. A description will be given, referring to FIG. 1, of a direct-current switch 20*a* of the first embodiment. The direct-current switch 20*a* is used inserted between a load 30 and a direct-current utility grid (direct-current power source) 10. In FIG. 1, the direct-current switch 20*a* is shown as a four terminal circuit having an input terminal A1, an input terminal B1, an output terminal C1, and an output terminal D1, but as the input terminal A1 and the output terminal C1 are electrically the same place, the same kind of working effect is also obtained when the direct-current switch 20*a* is a three terminal circuit having the input terminal A1, the input terminal B1, and the output terminal D1, without providing the output terminal C1. The utility grid 10 is connected to the input terminal A1 (+ side) and the input terminal B1 (− side). The load 30 is connected to the output terminal C1 (+ side) and the output terminal D1 − side) of the four terminal circuit and, although not shown, to the input terminal (input-output terminal) A1 (+ side) and the output terminal D1 (− side) when the direct-current switch 20*a* is a three terminal circuit having the input terminal (input-output terminal) A1, the input terminal B1, and the output terminal D1.

The direct-current switch 20*a* includes the parallel mechanical open/close switch 16, the electronic open/close switch 15, a switch control circuit 14, and a control switch 17. Then, the parallel mechanical open/close switch 16 and the electronic open/close switch 15 are connected in parallel, and the parallel connection circuit of the parallel mechanical open/close switch 16 and the electronic open/close switch 15 is inserted in the direct-current path between the utility grid 10 and load 30.

The load 30 is an electrical instrument, for example, a television receiver. The electrical instrument may be a rotary instrument as well as a static instrument, and as the rotary instrument, for example, a direct-current motor having a commutator or inverter motor can be given as examples. The parallel mechanical open/close switch 16 and the electronic open/close switch 15 of the direct-current switch 20*a* are inserted in order to make the direct-current path along which the direct current flows to the load 30 an open circuit (a condition in which the direct-current path is not formed) or a closed circuit (a condition in which the direct-current path is formed).

That is, the parallel mechanical open/close switch 16 and the electronic open/close switch 15 connected in parallel are such that both the parallel mechanical open/close switch 16 and the electronic open/close switch 15 are inserted in a minus side bus bar 13 on the input terminal B1 side, and connected in series between the utility grid 10 and load 30. For this reason, when either one of the parallel mechanical open/close switch 16 or electronic open/close switch 15 is closed (has continuity), the direct-current path has continuity (is a closed circuit), and when both the parallel mechanical open/close switch 16 and the electronic open/close switch 15 are opened (shut off), the direct-current path is shut off (an open circuit). With this opening and closing action, it is possible to cut off the supply of power to the load 30, or to supply power from the utility grid 10 to the load 30. In FIG. 1, the parallel mechanical open/close switch 16 and the electronic open/close switch 15 are inserted in the minus side bus bar 13, but the same working effect is also achieved by inserting the parallel mechanical open/close switch 16 and the electronic open/close switch 15 in a plus side bus bar 12 on the input terminal A1 side.

The switch control circuit 14 controls the opening or closing time difference mutually between the parallel mechanical open/close switch 16 and the electronic open/close switch 15. At this time, the control switch 17 carries out an opening or closing, and provides the switch control circuit 14 with a trigger signal which is the trigger for the opening or closing of the parallel mechanical open/close switch 16 and the electronic open/close switch 15. The control switch 17 is a switch operated by, for example, a human.

Figure 2:
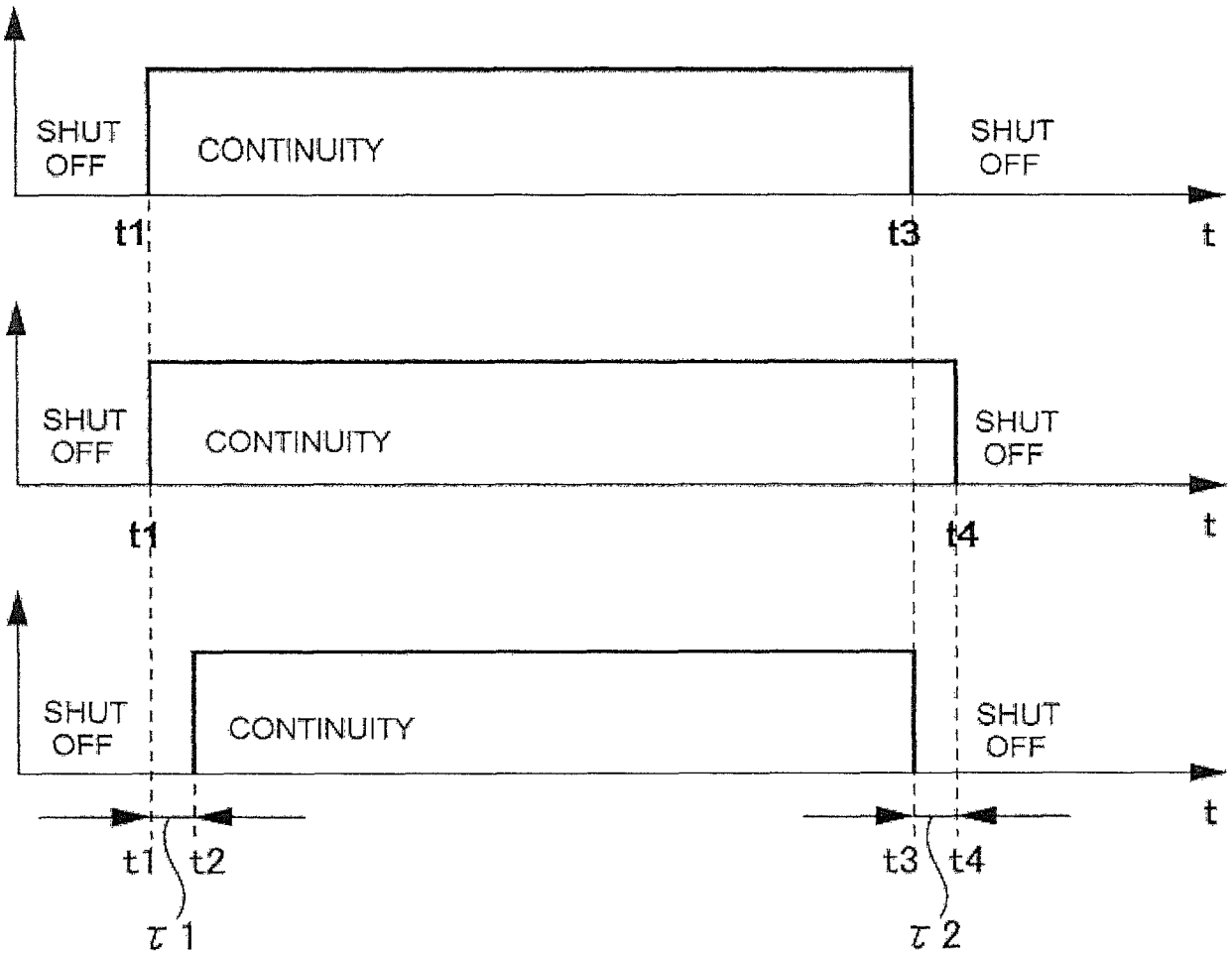
FIGS. 2A to 2C are diagrams showing the opening and closing procedures of a parallel mechanical open/close switch and an electronic open/close switch in the first embodiment in timing charts.

FIGS. 2A to 2C are diagrams wherein the opening and closing procedures of the control switch 17, parallel mechanical open/close switch 16, and the electronic open/close switch 15 in the first embodiment are shown in timing charts. FIG. 2A shows a shutting-off (a shut-off condition) wherein the control switch 17 is open, and continuity (a condition in which continuity is established) wherein the control switch 17 is closed, FIG. 2B shows a shutting-off (a shut-off condition) wherein the electronic open/close switch 15 is open, and continuity (a condition in which continuity is established) wherein the electronic open/close switch 15 is closed, and FIG. 2C shows a shutting-off (a shut-off condition) wherein the parallel mechanical open/close switch 16 is open, and continuity (a condition in which continuity is established) wherein the parallel mechanical open/close switch 16 is closed. The horizontal axis shows a time t. Referring to FIGS. 2A to 2C, the opening and closing actions of the control switch 17, electronic open/close switch 15, and parallel mechanical open/close switch 16 will be described. Firstly, a description will be given of the procedure when the direct-current path is made a closed circuit by the direct-current switch 20*a*.

The operator of the control switch 17 changes the control switch 17 from being shut off to having continuity (refer to a time t1 of FIG. 2A). The switch control circuit 14, based on the trigger signal generated by the control switch 17, changes the parallel mechanical open/close switch 16 and the electronic open/close switch 15 from being shut off to having continuity (refer to a time t1 of FIG. 2B, and a time t2 of FIG. 2C). That is, as shown in FIG. 2B, when the control switch 17 has continuity (is closed), the electronic open/close switch 15 has continuity (is closed), in principle with no delay in action, but with a very slight delay in action in an actual semiconductor device. Meanwhile, as shown in FIG. 2C, when the control switch 17 has continuity (is closed), the parallel mechanical open/close switch 16 has continuity (is closed) after a predetermined time τ1. Herein, during the predetermined time τ1 between the time t1 and time t2, only the electronic open/close switch 15 has continuity. Then, as power loss occurs in the electronic open/close switch 15 during the predetermined time τ1, the predetermined time τ1 is set to a short time in order that the temperature of the electronic open/close switch 15 does not rise to or above a predetermined temperature (for example, 60° C.).

It is sufficient that the predetermined time τ1 is equal to or longer than the delay in action of the electronic open/close switch 15. By increasing the length of the predetermined time τ1, it is possible to ensure that the parallel mechanical open/close switch 16 establishes continuity after the electronic open/close switch 15 has established sufficient continuity (after the turn-on voltage of the electronic open/close switch 15 has become sufficiently low). By setting the predetermined time τ1 in this way, the circuit is closed with a high voltage still being applied to the contacts of the parallel mechanical open/close switch 16, as a result of which, it does not happen that thermal loss occurs in the contacts.

That is, the maximum permissible length of the predetermined time τ1 is determined according to the permissible temperature of the electronic open/close switch 15, and the minimum permissible length of the predetermined time τ1 is determined according to the permissible thermal loss of the contacts of the parallel mechanical open/close switch 16, and the speed with which the electronic open/close switch 15 establishes continuity. Furthermore, the longer is the predetermined time τ1, the greater is the power loss occurring in the electronic open/close switch 15 in the direct-current path. The predetermined time τ1 is determined taking the above into consideration.

In this way, it is ensured that the parallel mechanical open/close switch 16 does not establish continuity before the electronic open/close switch 15. When the parallel mechanical open/close switch 16 establishes continuity before the electronic open/close switch 15, there is a danger of an arc being generated between the contacts of the parallel mechanical open/close switch 16, causing damage to the contacts. In particular, the possibility of an arc being generated due to chattering of the contacts is increased. Herein, chattering is a phenomenon wherein, when the contacts of the parallel mechanical open/close switch 16 switch over, the contacts alternate between making and breaking due to a miniscule and extremely rapid mechanical vibration of the contacts, causing continuity of the current flowing along the direct-current path on and off, sustaining for the duration in the region of, for example, 1 to 100 ms (milliseconds).

Next, a description will be given of the procedure when the direct-current path is made an open circuit by the direct-current switch 20*a*. The operator changes the control switch 17 from having continuity to being shut off (refer to a time t3 of FIG. 2A). The switch control circuit 14, based on the trigger signal generated by the control switch 17, changes the parallel mechanical open/close switch 16 from having continuity to being shut off (refer to a time t3 of FIG. 2C). Also, the switch control circuit 14 changes the electronic open/close switch 15 from having continuity to being shut off at a time t4 a predetermined time τ2 after changing the parallel mechanical open/close switch 16 from having continuity to being shut off based on the trigger signal generated by the control switch 17. Herein, the predetermined time τ2 between the time t3 and time t4 is set to a time equal to or longer than the time needed for the chattering of the parallel mechanical open/close switch 16 to abate, and the predetermined time τ2 is set within a time shorter than the time taken for the temperature of the electronic open/close switch 15 to rise to a predetermined temperature.

When changing from having continuity to being shut off with the aforementioned procedure, the predetermined time τ2 is set to a time longer than the time needed for the chattering of the parallel mechanical open/close switch 16 to abate. Therefore, at a point at which the parallel mechanical open/close switch 16 is completely opened after the chattering of the parallel mechanical open/close switch 16 has abated, the electronic open/close switch 15 is still closed. For this reason, when the electronic open/close switch 15 is, for example, a MOSFET, the resistance value of the electronic open/close switch 15 is low, and the voltage across the electronic open/close switch 15 is small, for the duration of the predetermined time τ2. Therefore, even in the event that a chattering occurs between the contacts of the parallel mechanical open/close switch 16 for a time within the predetermined time τ2, no arc is generated between the contacts of the parallel mechanical open/close switch 16.

Also, when the electronic open/close switch 15 is, for example, a bipolar-transistor, it does not happen that a voltage equal to or greater than the turn-on voltage of the electronic open/close switch 15 is generated across the contacts. Therefore, no arc is generated between the contacts of the parallel mechanical open/close switch 16.

Also, as the predetermined time τ2 is set to a time shorter than the time taken for the temperature of the electronic open/close switch 15 to rise to the predetermined temperature (for example, a temperature determined by safety standards, or a temperature determined by a semiconductor rating), the electronic open/close switch 15 maintains a safe, low temperature, and there is no thermal breakdown occurring. Then, the direct-current path is in a shut-off (open) condition at the point at which the electronic open/close switch 15 is opened.

That is, the maximum permissible length of the predetermined time τ2 is determined according to the permissible temperature of the electronic open/close switch 15, and as the minimum permissible length of the predetermined time τ2 is the time for which the chattering of the parallel mechanical open/close switch 16 continues, the predetermined time τ2 is a time equal to or longer than the time for which the chattering continues. Furthermore, the longer is the predetermined time τ2, the greater is the power loss occurring in the electronic open/close switch 15 in the direct-current path. The predetermined time τ2 has been determined taking the above into consideration.

That is, in the first embodiment, the time for which the electronic open/close switch 15 has continuity is determined in such a way as to overlap the time for which the parallel mechanical open/close switch 16 has continuity in an anterior direction (the direction before t2) and a posterior direction—(the direction after t3). Then, the predetermined time τ1, which is the time overlapping in the anterior direction, and the predetermined time τ2, which is the time overlapping in the posterior direction, are set within a time shorter than the time taken for the temperature of the electronic open/close switch 15 to rise to a predetermined temperature, and are times such that it is possible to ignore power loss occurring in the electronic open/close switch 15. Also, the predetermined time τ2 is set to a time equal to or longer than the time needed for the chattering of the parallel mechanical open/close switch 16 to abate.

Figure 3:
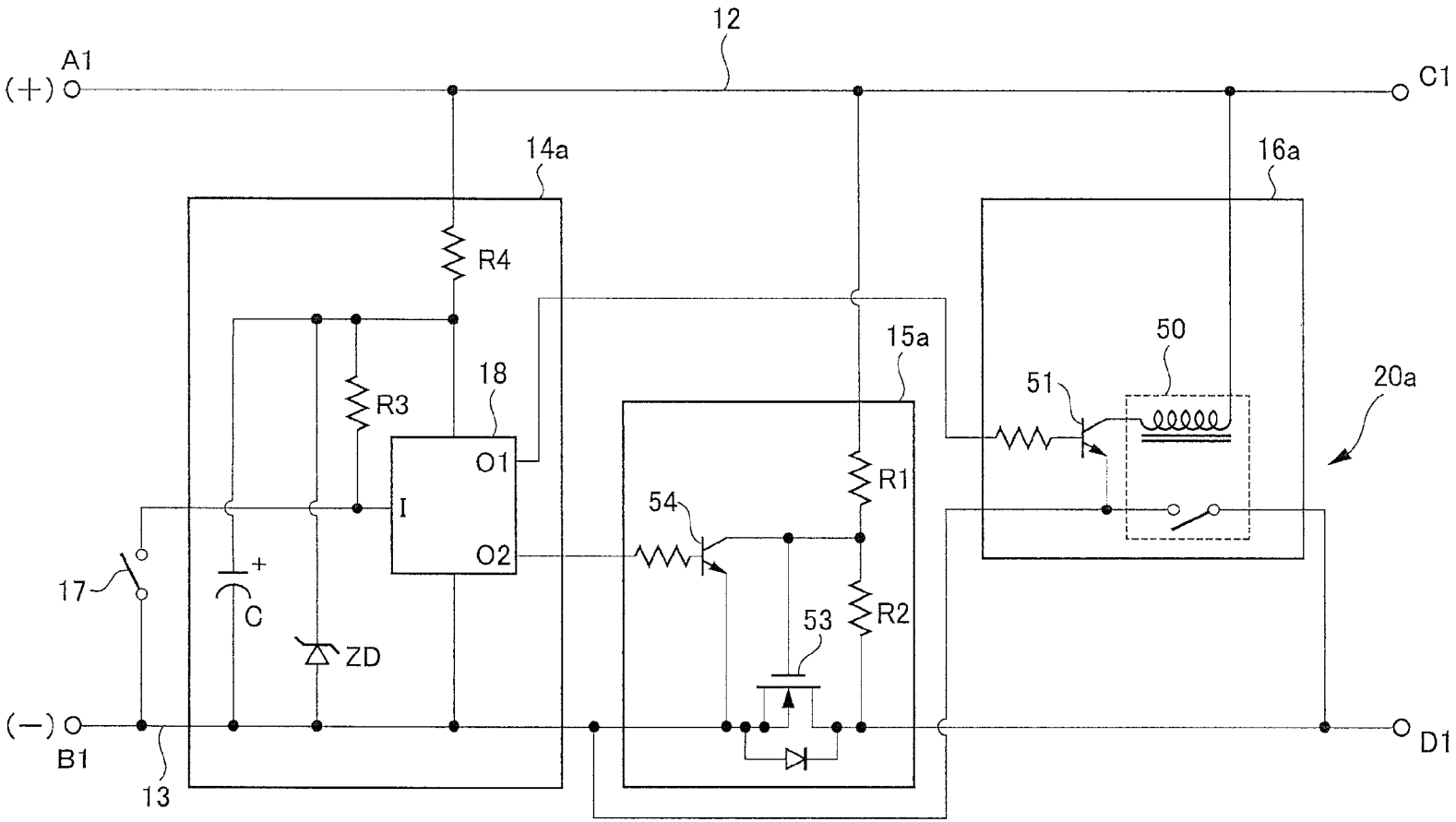
FIG. 3 is a diagram showing a working example of a direct-current switch shown in FIG. 1.

FIG. 3 is a diagram showing a working example of the direct-current switch 20*a* shown in FIG. 1. Referring to FIG. 3, a description will be given of one example of a more specific configuration of the direct-current switch 20*a*. A parallel mechanical open/close switch 16*a*, which is one working example of the parallel mechanical open/close switch 16, is configured having a relay 50 that mechanically opens and closes contacts and a bipolar-transistor 51 that drives the relay 50, and it is possible to control a current flowing through a coil winding of the relay 50 via the bipolar-transistor 51. For example, the contacts are closed when a current is flowing through the coil winding, and the contacts are opened when no current is flowing through the coil winding.

An electronic open/close switch 15*a*, which is one working example of the electronic open/close switch 15, is formed with a metal oxide semiconductor field effect transistor (MOSFET) 53 and a bipolar-transistor 54 as main components. The connection point of a resistor R1 and resistor R2, and the collector of the bipolar-transistor 54, are connected to the gate of the MOSFET 53, and the MOSFET 53 is configured in such a way as to open and close a direct-current path. Herein, the configuration is such that the gate voltage is lowered, and the drain-to-source resistance is high, when making the electronic open/close switch 15*a* an open circuit, and the gate voltage is raised, and the drain-to-source resistance is low, when making the electronic open/close switch 15*a* a closed circuit.

A switch control circuit 14*a*, which is one working example of the switch control circuit 14, is configured of a digital logic circuit 18 and a peripheral circuit. A resistor R4 is for supplying an operating voltage to the digital logic circuit 18, and the operating voltage is kept at a constant voltage by a Zener diode ZD and a capacitor C. A resistor R3 is connected to one of the two ends of a control switch 17, and a bus bar 13 is connected to the other end of the control switch 17. A change between a shutting-off and establishing of continuity of the control switch 17 is transmitted as a trigger signal, and the trigger signal is input into a signal input terminal I of the digital logic circuit 18. The digital logic circuit 18 is equipped with a signal output terminal O1 and a signal output terminal O2, and the configuration is such that a signal from the signal output terminal O1 is applied to the base of the bipolar-transistor 51, and a signal from the signal output terminal O2 is applied to the base of the bipolar-transistor 54. With the aforementioned switch control circuit 14*a*, which is one working example of the switch control circuit 14, it is possible to realize the actions shown in the timing charts of FIGS. 2A to 2C. The configuration is such that the contacts of the relay 50 are closed when the level of the signal from the signal output terminal O1 is high, and the drain-to-source resistance of the MOSFET 53 is low when the level of the signal from the signal output terminal O2 is low, that is, the electronic open/close switch 15*a* is made a closed circuit.

In the heretofore described circuit example, a MOSFET is used as the electronic open/close switch, and a bipolar-transistor is used as a circuit portion that drives the MOSFET, but with regard to the combination of the two, it is possible to obtain the same benefit from any combination of semiconductor devices such as a MOSFET, a bipolar-transistor, or an IGBT. For example, it is also possible to use a bipolar-transistor as the electronic open/close switch, and to use a MOSFET as a circuit portion that drives the bipolar-transistor.

Second Embodiment

Figure 4:
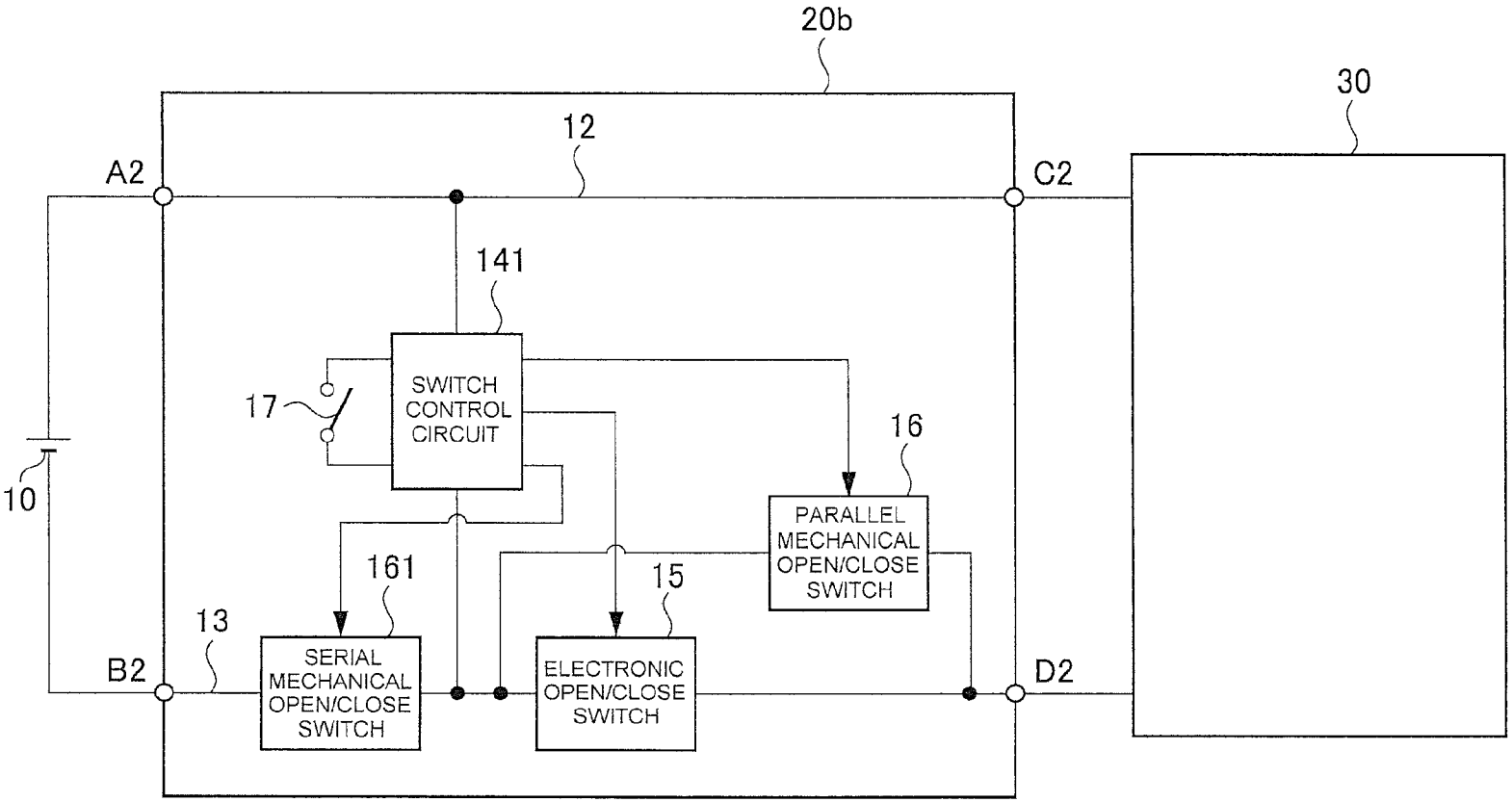
FIG. 4 is a diagram showing a second embodiment.

FIG. 4 is a diagram showing the second embodiment. FIG. 4 shows a direct-current switch 20*b* acting as a direct-current switch of the second embodiment. The direct-current switch 20*b* of the second embodiment includes a parallel mechanical open/close switch 16 and a serial mechanical open/close switch 161 inserted in a direct-current path along which a direct current flows in order to make the direct-current path an open circuit or a closed circuit, an electronic open/close switch 15, and a switch control circuit 141. Herein, as the serial mechanical open/close switch 161 is connected in series with the electronic open/close switch 15, it is called a serial mechanical open/close switch, as heretofore described.

A characteristic of the direct-current switch of the second embodiment is that, while maintaining the characteristic of the first embodiment wherein power loss in a closed circuit condition of the direct-current path is small, furthermore, the serial mechanical open/close switch 161 is inserted in series with the electronic open/close switch 15 of the direct-current path, making the shutting-off of the direct-current path more reliable, and improving safety.

The parallel mechanical open/close switch 16 and serial mechanical open/close switch 161 in the direct-current switch 20*b* of the second embodiment have the same configuration as the parallel mechanical open/close switch 16 in the direct-current switch 20*a* of the first embodiment, and the electronic open/close switch 15 in the direct-current switch 20*b* of the second embodiment has the same configuration as the electronic open/close switch 15 in the direct-current switch 20*a* of the first embodiment.

Then, the parallel mechanical open/close switch 16 and the electronic open/close switch 15 are connected in parallel, and this parallel connection circuit and the serial mechanical open/close switch 161 are connected in series. Therefore, a series connection circuit, formed of the parallel connection circuit of the parallel mechanical open/close switch 16 and the electronic open/close switch 15, and the serial mechanical open/close switch 161 connected in series with the parallel connection circuit, is disposed between a utility grid 10 and a load 30 so as to form a series circuit therewith.

Figure 5:
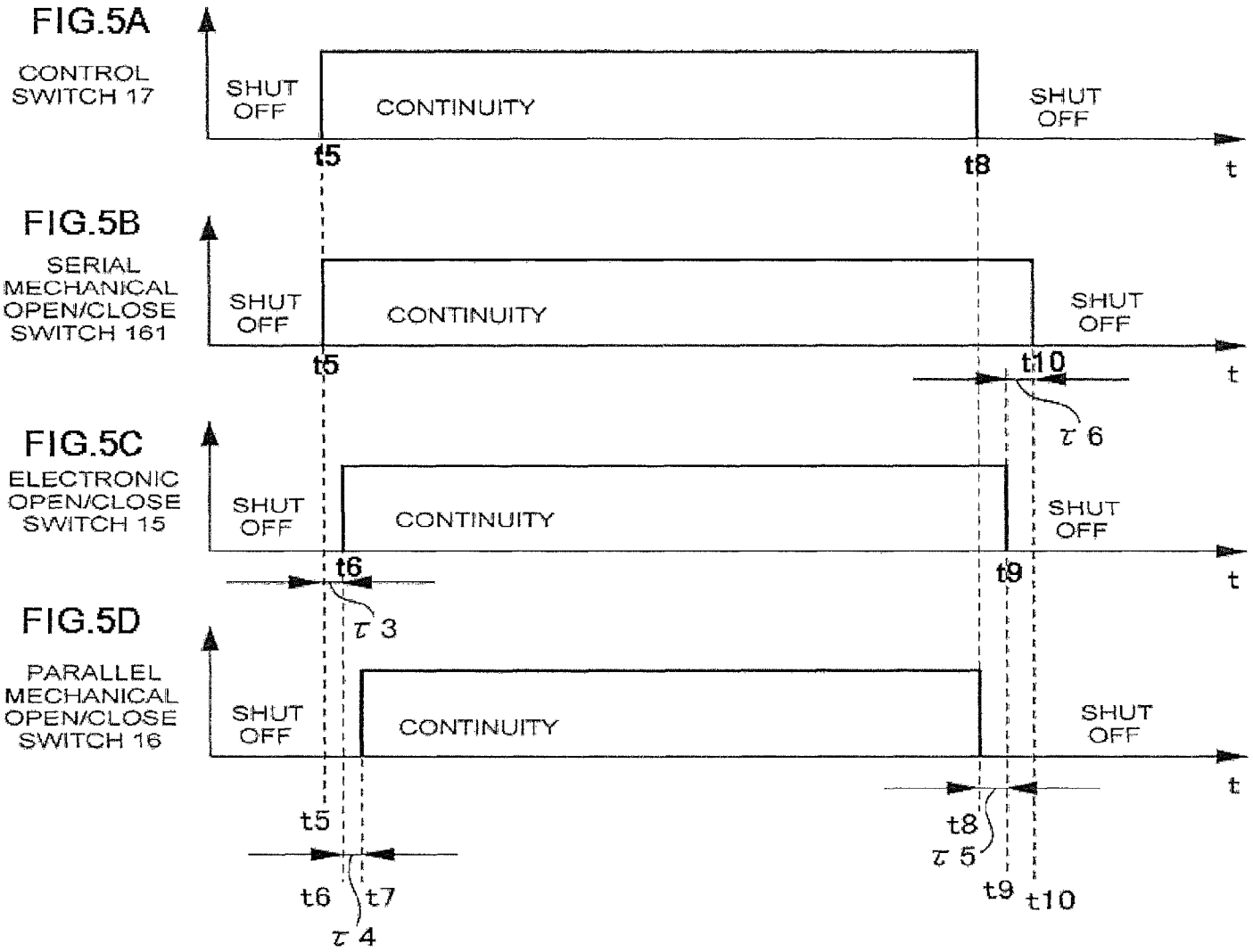
FIGS. 5A to 5D are diagrams showing the opening and closing procedures of a parallel mechanical open/close switch, electronic open/close switch, and serial mechanical open/close switch in the second embodiment in timing charts.

FIGS. 5A to 5D are diagrams wherein the opening and closing procedures of a control switch 17, the parallel mechanical open/close switch 16, the electronic open/close switch 15, and the serial mechanical open/close switch 161 are shown in timing charts. FIG. 5A shows a shutting-off (a shut-off condition) and continuity (a condition in which continuity is established) of the control switch 17, FIG. 5B shows a shutting-off (a shut-off condition) and continuity (a condition in which continuity is established) of the serial mechanical open/close switch 161, FIG. 5C shows a shutting-off (a shut-off condition) and continuity (a condition in which continuity is established) of the electronic open/close switch 15, and FIG. 5D shows a shutting-off (a shut-off condition) and continuity (a condition in which continuity is established) of the parallel mechanical open/close switch 16. The horizontal axis shows a time t. The above-mentioned control is carried out by the switch control circuit 141.

Herein, the mutual relationship between the shutting-off (a shut-off condition) and continuity (a condition in which continuity is established) of the electronic open/close switch 15 and the shutting-off (a shut-off condition) and continuity (a condition in which continuity is established) of the parallel mechanical open/close switch 16 indicated in FIGS. 5C and 5D is the same as that indicated in FIGS. 2B and 2C. That is, the parallel mechanical open/close switches 16 acts regarding the electronic open/close switches 15 with the same temporal relationship shown in FIG. 5D and FIG. 5C as shown in FIG. 2C and FIG. 2B.

That is, the parallel mechanical open/close switch 16 establishes continuity at a time t7, which is a predetermined time τ4 after a time t6 at which the electronic open/close switch 15 has established continuity, and the predetermined time τ4 (refer to FIG. 5D) and the predetermined time τ1 (refer to FIG. 2C) are determined based on the same criterion. Also, although the electronic open/close switch 15 is shut off at a time t9, which is a predetermined time τ5 after a time t8 at which the parallel mechanical open/close switch 16 has been shut off, the predetermined time τ5 (refer to FIG. 5D) and the predetermined time τ2 (refer to FIG. 2C) are determined based on the same criterion.

Firstly, referring to FIGS. 5A to 5D, a description will be given of the procedure when the direct-current path is made a closed circuit by the direct-current switch 20*b*.

The operator of the control switch 17 changes the control switch 17 from being shut off to having continuity (refer to a time t5 of FIG. 5A). The switch control circuit 141 changes the serial mechanical open/close switch 161 from being shut off to having continuity (refer to a time t5 of FIG. 5B) based on a trigger signal generated by the control switch 17. That is, as shown in FIG. 5B, when the control switch 17 has continuity (closing), the serial mechanical open/close switch 161 has continuity (closing). Herein, even though the serial mechanical open/close switch 161 has continuity, both the electronic open/close switch 15 and parallel mechanical open/close switch 16 are opened, no current flows through the serial mechanical open/close switch 161. Then, the switch control circuit 141 establishes continuity in the electronic open/close switch 15 a predetermined time τ3 after the time t5.

The direct-current path is closed at a time t6 at which the serial mechanical open/close switch 161 and the electronic open/close switch 15 establish continuity, and power is supplied to the load 30. Herein, the length of the predetermined time τ3 between the time t5 and time t6 is greater than that of the time taken for the chattering of the contacts of the serial mechanical open/close switch 161 to abate (die out). In this way, the occurrence of an arc between the contacts of the serial mechanical open/close switch 161 is prevented.

When changing from being shut off to having continuity with the above-mentioned procedure, the electronic open/close switch 15 is still opened at the point at which the serial mechanical open/close switch 161 is closed and, as no voltage is applied across the contacts of the serial mechanical open/close switch 161, no arc is generated between the contacts of the serial mechanical open/close switch 161, even in the event that chattering occurs.

Although the temporal relationship between the mutual actions of the electronic open/close switch 15 and parallel mechanical open/close switch 16 is the same as in the first embodiment, as heretofore mentioned, a description will be given below; the parallel mechanical open/close switch 16 establishes continuity (closing) at the time t7 that is the predetermined time τ4 after the time t6 at which the electronic open/close switch 15 has established continuity. Herein, it is desirable that the predetermined time τ4 is a short time so that the temperature of the electronic open/close switch 15 does not rise to or above a predetermined temperature.

In the case there is absolutely no delay, a condition of continuity is established immediately by a control signal from the switch control circuit 141, in the action of the electronic open/close switch 15, the predetermined time τ4 may be zero, but by increasing the length of the predetermined time τ4, it is possible to ensure that the parallel mechanical open/close switch 16 establishes continuity after the electronic open/close switch 15 has established sufficient continuity (after the turn-on voltage of the electronic open/close switch 15 has become sufficiently low). In the event that the parallel mechanical open/close switch 16 were to establish continuity before the electronic open/close switch 15, there is a possibility of an arc being generated due to chattering of the contacts of the parallel mechanical open/close switch 16, and this kind of control cannot be employed.

Next, a description will be given of the procedure when the direct-current path is made an open circuit by the direct-current switch 20*b*. The operator changes the control switch 17 from having continuity to being shut off (refer to a time t8 of FIG. 5A). The switch control circuit 141 changes the parallel mechanical open/close switch 16 from having continuity to being shut off (refer to a time t8 of FIG. 5D) based on a trigger signal generated by the control switch 17. Also, the switch control circuit 141 changes the electronic open/close switch 15 from having continuity to being shut off at the time t9 that is the predetermined time τ5 after changing the parallel mechanical open/close switch 16 from having continuity to being shut off based on the trigger signal generated by the control switch 17. Herein, the predetermined time τ5 is set to a time equal to or longer than the time needed for the chattering of the parallel mechanical open/close switch 16 to abate, and is set within a time shorter than the time taken for the temperature of the electronic open/close switch 15 to rise to a predetermined temperature. Furthermore, the longer is the predetermined time τ5, the greater is the power loss occurring in the electronic open/close switch 15 in the direct-current path. The predetermined time τ5 is determined taking the above into consideration.

Then, the serial mechanical open/close switch 161 is made an open circuit after a predetermined time τ6, which is after the electronic open/close switch 15 has been made an open circuit. Herein, the predetermined time τ6 may be zero, but by increasing the length of the predetermined time τ6, it is possible to ensure that the serial mechanical open/close switch 161 is shut off after the electronic open/close switch 15 is sufficiently shut off.

When changing from having continuity to being shut off with the aforementioned procedure, the electronic open/close switch 15 is still closed at a point at which the parallel mechanical open/close switch 16 is opened and, even in the event that a chattering occurs between the contacts of the parallel mechanical open/close switch 16, it does not happen that a voltage equal to or greater than the turn-on voltage of the electronic open/close switch 15 is generated across the contacts of the parallel mechanical open/close switch 16, and no arc is generated between the contacts. Then, the direct-current path is put into a shut-off (opened) condition at the point at which the electronic open/close switch 15 is opened.

Then, lastly, the shutting-off of the direct-current path is made more reliable by shutting-off (opening) the serial mechanical open/close switch 161. The switch control circuit 141 controls in such a way that the shutting-off of the serial mechanical open/close switch 161 is carried out at a time t10 delayed by the predetermined time τ6 after the time t9. It is desirable that the length of the predetermined time τ6 is selected so that the shutting-off of the serial mechanical open/close switch 161 is carried out after the shutting-off (opening) of the electronic open/close switch 15 has been sufficiently carried out (after the electronic open/close switch 15 has been in a completely shut-off condition). That is, in the case that the delay in the action of the electronic open/close switch 15 is long, the predetermined time τ6 is lengthened so that the contacts of the serial mechanical open/close switch 161 are not damaged.

That is, in the second embodiment, the time for which the electronic open/close switch has continuity is determined in such a way as to overlap the time for which the parallel mechanical open/close switch has continuity in the anterior and posterior directions. Also, the time for which the serial mechanical open/close switch has continuity is determined in such a way as to overlap the time for which the electronic open/close switch has continuity in the anterior and posterior directions. Herein, the time needed for the chattering of the contacts of the serial mechanical open/close switch to abate in such a way as to overlap the time for which the electronic open/close switch has continuity in the anterior direction.

Third Embodiment

Figure 6:
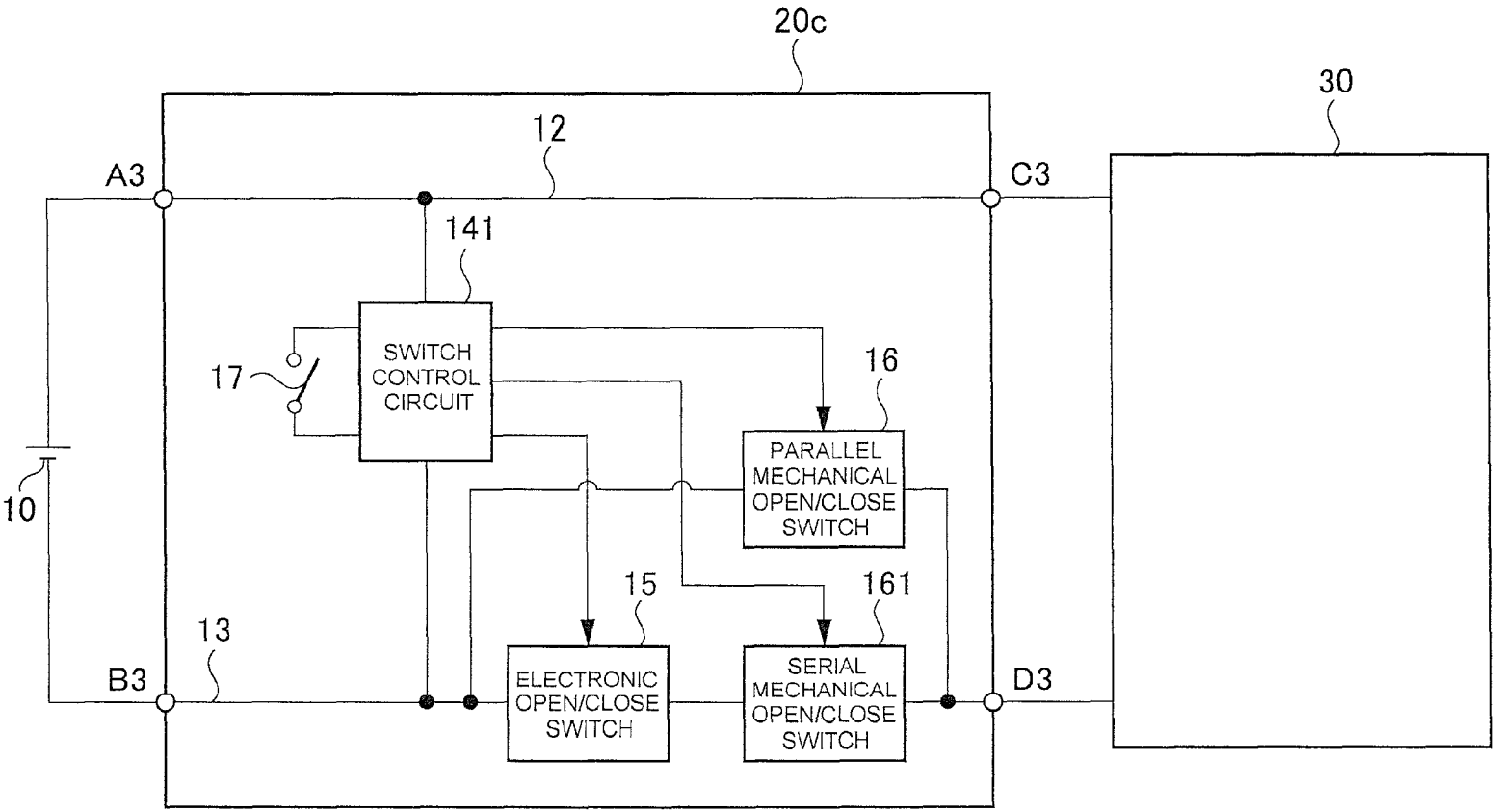
FIG. 6 is a diagram showing a third embodiment.

FIG. 6 is a diagram showing the third embodiment. FIG. 6 shows a direct-current switch 20*c* acting as a direct-current switch of the third embodiment. The direct-current switch 20*c* of the third embodiment includes a parallel mechanical open/close switch 16 and a serial mechanical open/close switch 161 inserted in a direct-current path along which a direct current flows in order to make the direct-current path an open circuit or a closed circuit, an electronic open/close switch 15, and a switch control circuit 141. A characteristic of the direct-current switch of the third embodiment is that, while maintaining the characteristic of the first embodiment wherein power loss in a continuity condition of the direct-current path is small, furthermore, the serial mechanical open/close switch 161 is inserted in series in the direct-current path, making the shutting-off of the direct-current path more reliable, and improving safety.

The parallel mechanical open/close switch 16 and serial mechanical open/close switch 161 in the direct-current switch 20*c* of the third embodiment have the same configuration as the parallel mechanical open/close switch 16 in the direct-current switch 20*a* of the first embodiment, and the electronic open/close switch 15 in the direct-current switch 20*c* of the third embodiment has the same configuration as the electronic open/close switch 15 in the direct-current switch 20*a* of the first embodiment.

Then, the series mechanical open/close switch 161 and the electronic open/close switch 15 are connected in series, and this series connection circuit and the parallel mechanical open/close switch 16 are connected in parallel. Therefore, a parallel connection circuit formed of the series connection circuit of the series mechanical open/close switch 161 and the electronic open/close switch 15 and the parallel mechanical open/close switch 16 connected in parallel to the series connection circuit is disposed between a utility grid 10 and a load 30 so as to form a series circuit therewith.

A comparison will be made of the second embodiment shown in FIG. 4 and third embodiment shown in FIG. 6, focusing on the connection aspect of the mechanical open/close switch and the electronic open/close switch inserted in the bus bar 13. The serial mechanical open/close switch 161 and the electronic open/close switch 15 are connected in series in both the second embodiment shown in FIG. 4 and the third embodiment shown in FIG. 6. Also, in the second embodiment shown in FIG. 4, the parallel mechanical open/close switch 16 is connected in parallel to the electronic open/close switch 15, while in the third embodiment shown in FIG. 6, the parallel mechanical open/close switch 16 is connected in parallel to the electronic open/close switch 15 via the serial mechanical open/close switch 161.

Owing to the aforementioned commonality of connection aspect of the direct-current switch 20*b* of the second embodiment and direct-current switch 20*c* of the third embodiment, timing charts to show the opening and closing procedures of a control switch 17, the parallel mechanical open/close switch 16, electronic open/close switch 15, and serial mechanical open/close switch 161 in the third embodiment are the same as FIGS. 5A to 5D, so a description will be given referring again to FIGS. 5A to 5D.

FIG. 5A shows a shutting-off (a shut-off condition) and continuity (a condition in which continuity is established) of the control switch 17, FIG. 5B shows a shutting-off (a shut-off condition) and continuity (a condition in which continuity is established) of the serial mechanical open/close switch 161, FIG. 5C shows a shutting-off (a shut-off condition) and continuity (a condition in which continuity is established) of the electronic open/close switch 15, and FIG. 5D shows a shutting-off (a shut-off condition) and continuity (a condition in which continuity is established) of the parallel mechanical open/close switch 16. The horizontal axis shows time t. Such control is carried out by the switch control circuit 141.

That is, although the parallel mechanical open/close switch 16 establishes continuity at a time t7 that is a predetermined time τ4 after a time t6 at which the electronic open/close switch 15 has established continuity, the predetermined time τ4 (refer to FIG. 5D) and the predetermined time τ1 (refer to FIG. 2C) are determined based on the same criterion. Also, although the electronic open/close switch 15 is shut off at a time t9, which is a predetermined time τ5 after a time t8 at which the parallel mechanical open/close switch has been shut off, the predetermined time τ5 (refer to FIG. 5D) and the predetermined time τ2 (refer to FIG. 2C) are determined based on the same criterion. Also, a predetermined time τ3 (refer to FIG. 5C) and a predetermined time τ6 (refer to FIG. 5B) are times having the same significance as in the second embodiment.

As the opening and closing procedure of the direct-current switch 20*c* of the third embodiment is the same as that shown in the second embodiment, a description will be omitted.

That is, in the third embodiment, the time for which the electronic open/close switch 15 has continuity is determined in such a way as to overlap the time for which the parallel mechanical open/close switch 16 has continuity in the anterior and posterior directions. Also, the time for which the serial mechanical open/close switch 161 has continuity is determined in such a way as to overlap the time for which the electronic open/close switch 15 has continuity in the anterior and posterior directions. Herein, the time needed for the chattering of the contacts of the mechanical open/close switch (the serial mechanical open/close switch) to abate is such as to overlap the time for which the electronic open/close switch has continuity in the anterior direction.

In each of the heretofore described first to third embodiments, a direct-current switch includes an electronic open/close switch inserted in a direct-current path along which a direct current flows in order to make the direct-current path an open circuit or a closed circuit, a parallel mechanical open/close switch connected in parallel to the electronic open/close switch, and a switch control circuit that controls the opening or closing time difference mutually between the parallel mechanical open/close switch and the electronic open/close switch, and the switch control circuit makes the parallel mechanical open/close switch a closed circuit a predetermined time after the electronic open/close switch has been made a closed circuit.

By configuring in this way, it does not happen that an arc is generated between the contacts of the parallel mechanical open/close switch due to chattering when the parallel mechanical open/close switch is made a closed circuit. Also, as the parallel mechanical open/close switch is made a closed circuit a predetermined time after the electronic open/close switch has been made a closed circuit, current flows through the electronic open/close switch only for this predetermined time, and it is possible to prevent a rise in temperature of the electronic open/close switch. Then, a reduction in size of the parallel mechanical open/close switch and the electronic open/close switch, and furthermore, a reduction in size of a heat sink provided in the electronic open/close switch, are achieved.

Also, the switch control circuit makes the parallel mechanical open/close switch an open circuit when making the direct-current path along which the direct current flows an open circuit, and makes the electronic open/close switch an open circuit within a time longer than the time needed for chattering occurring due to the parallel mechanical open/close switch being made an open circuit to abate, and shorter than the time taken for the temperature of the electronic open/close switch to rise to a predetermined temperature.

Also, in both the heretofore described second embodiment and third embodiment, the direct-current switch includes a serial mechanical open/close switch connected in series to the electronic open/close switch, in addition to the electronic open/close switch and parallel mechanical open/close switch, and when making the direct-current path along which the direct current flows a closed circuit, the electronic open/close switch is made a closed circuit after a predetermined time longer than the time needed for chattering occurring due to the serial mechanical open/close switch being made a closed circuit to abate.

Also, when making the direct-current path, along which the direct current flows, an open circuit, the serial mechanical open/close switch is made an open circuit after the electronic open/close switch has been made an open circuit.

By configuring in this way, as the parallel mechanical open/close switch is made a closed circuit a predetermined time after the electronic open/close switch has been made a closed circuit in both the second embodiment and the third embodiment too, in the same way as in the first embodiment, it does not happen that an arc is generated between the contacts of the parallel mechanical open/close switch due to chattering when the parallel mechanical open/close switch is made a closed circuit. Also, current flows through the electronic open/close switch only for this predetermined time, and it is possible to prevent a rise in temperature of the electronic open/close switch. Then, a reduction in size of the parallel mechanical open/close switch and the electronic open/close switch, and furthermore, a reduction in size of a heat sink provided in the electronic open/close switch, are achieved. In addition, as the serial mechanical open/close switch and the electronic open/close switch are disposed in series in the direct-current path, the two contacts of the serial mechanical open/close switch are separated from each other by the serial mechanical open/close switch being opened, the direct-current path is physically shut off, and safety for a direct-current switch further increases. Furthermore, as the serial mechanical open/close switch is opened last, no arc is generated between the contacts of the serial mechanical open/close switch.

Embodiment Modification Examples

Direct-Current Switch with Power Regenerative Circuit

In the first embodiment to the third embodiment, in the case wiring from the output terminal C1 and the output terminal D1 of the direct-current switch 20*a* to the load 30 is long, and the wiring has inductance, in the case wiring from the output terminal C2 and the output terminal D2 of the direct-current switch 20*b* to the load 30 is long, and the wiring has inductance, or in the case wiring from the output terminal C3 and the output terminal D3 of the direct-current switch 20*c* to the load 30 is long, and the wiring has inductance, giving special consideration to the generation of the counter electromotive force in any of the load 30 side, bus bar side, or each direct-current switch (the direct-current switch 20*a*, direct-current switch 20*b*, or direct-current switch 20*c*) side is a problem to be solved from the point of view of preventing a high voltage to the direct-current switch from being applied. Also, in the case the load 30 is a load such as a motor that has an inductance component, it is desirable to give the same kind of consideration even when the wiring is short. Furthermore, in the case the load is a motor, how to effectively utilize the electromotive force generated is a problem that needs to be solved.

That is, in the case an inductance load (a load having an inductance component) is connected to the output side of each direct-current switch, a large counter electromotive force is applied between the output terminal C1 and the output terminal D1, between the output terminal C2 and the output terminal D2, and between the output terminal C3 and the output terminal D3, immediately after the shutting-off of each direct-current switch. Each direct-current switch and other instruments in the wire path are affected by this counter electromotive force, and it may happen that each direct-current switch and other instruments are destroyed.

In order to prevent the aforementioned counter electromotive force from being generated, it is desirable to provide a commutating diode inside the load 30. It is possible to prevent a large counter electromotive force from being generated due to the working of the commutating diode. Whether or not a commutating diode is provided inside the load 30 depends on the will of the manufacturer of the electrical instrument which is the load, meaning that it may happen that no commutating diode is provided inside the electrical instrument. In this case, measures are taken against the counter electromotive force in the wire path from the direct-current switch as far as to the load, or inside the direct-current switch.

Furthermore, when the load is a motor, it is more desirable to provide a regenerative diode that returns electromotive force to the utility grid side. The commutating diode itself and the regenerative diode (power regenerative diode) itself are heretofore known technologies. However, it is not yet known how to utilize the commutating diode and regenerative diode technologies in a direct-current switch in which the direct-current path between the utility grid and the load is shut off by an electronic open/close switch or mechanical open/close switch.

The following embodiments provide a direct-current switch wherein a commutating diode and a regenerative diode are further added to the heretofore described direct-current switch. Then, the embodiments solve the problems of preventing the generation of the counter electromotive force and returning the electromotive force to the utility grid side.

As a measure against the counter electromotive force in each direct-current switch, it is possible to provide in advance a commutating diode between the output terminal C1 and the output terminal D1, between the output terminal C2 and the output terminal D2, and between the output terminal C3 and the output terminal D3, inside each direct-current switch.

Figure 7:
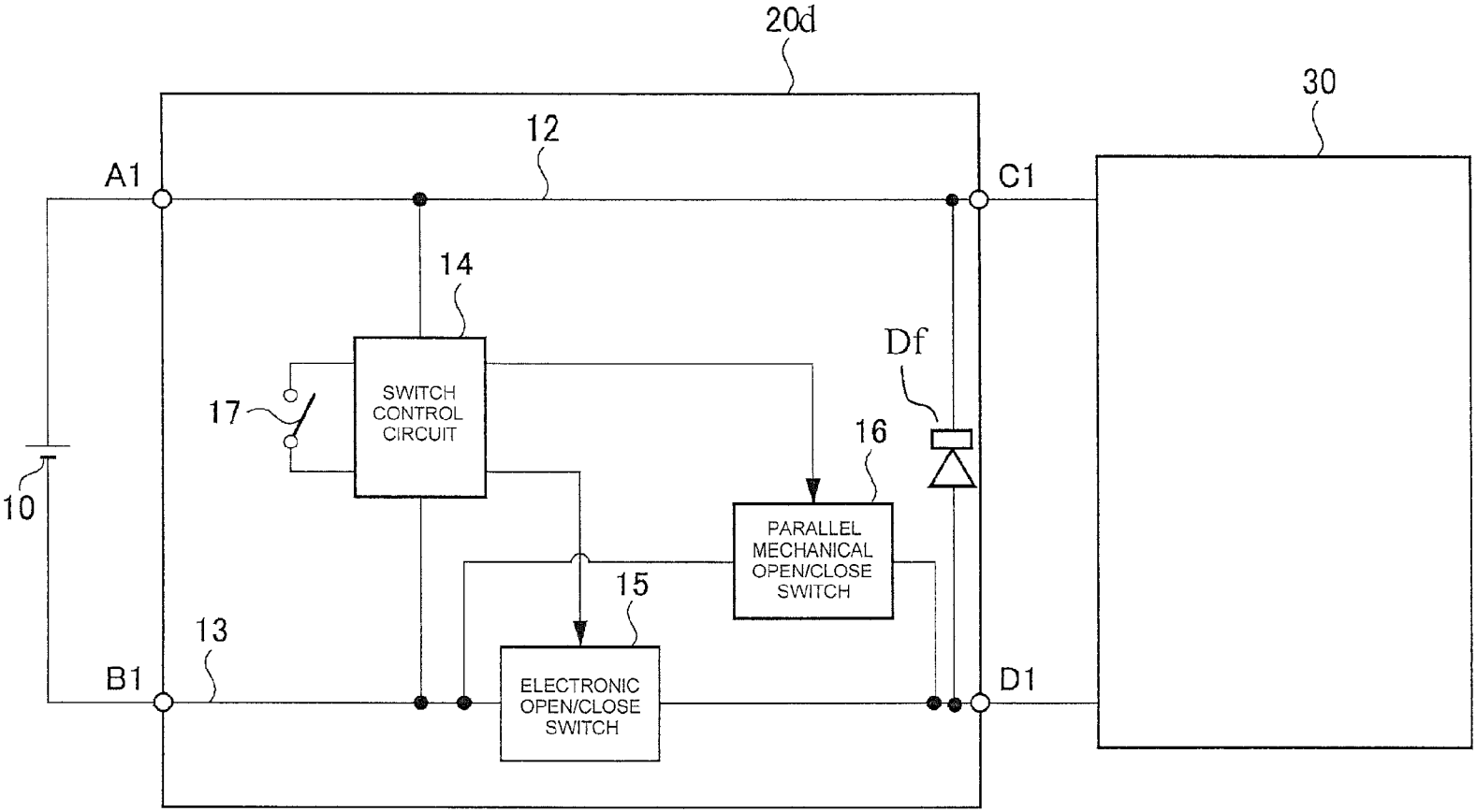
FIG. 7 is a diagram showing a first modification example of a direct-current switch.

FIG. 7 is a diagram showing a first modification example of a direct-current switch. In a direct-current switch 20*d* shown in FIG. 7, a diode Df that functions as a commutating diode is provided inside the direct-current switch. As each portion of the direct-current switch 20*d* shown in FIG. 7 other than the diode Df is the same as those of the direct-current switch 20*a* shown in FIG. 1, a description will be omitted. As it is sufficient to provide the diode Df between the output terminal C1 and the output terminal D1 so that it is reverse-biased, the position thereof is not strictly specified. By providing the diode Df inside the direct-current switch 20*d* so that it is reverse-biased in this way, a forward current is caused to flow through the diode Df immediately after the direct-current path of the load 30 having inductance is opened, the generation of the counter electromotive force is prevented, and it is possible to prevent the direct-current switch 20*d* from being destroyed.

With regard to a regenerative diode, In the case that a MOSFET is used as the electronic open/close switch in the direct-current switch 20*d*, a body diode (refer to FIG. 3) which is reverse-biased with respect to the MOSFET 35 performs as a regenerative diode. Therefore, it is not absolutely necessary to add a regenerative diode. In the case of using a bipolar-transistor as the electronic open/close switch, a regenerative diode is provided in the same position as the body diode. By so doing, a regenerative current is caused to flow through the body diode which is reverse-biased at a time of a normal action immediately after the direct-current switch 20*d* is opened, and it is possible to regenerate the power generated from the load 30 the utility grid.

In FIG. 7, the diode Df is connected in parallel to an end of both the output terminal C1 and the output terminal D1 of the direct-current switch 20*d* so as to be reverse-biased, the reason for this is to protect all the parts inside the direct-current switch 20*d*. Although not shown, when the object is to particularly protect the electronic open/close switch 15*a* (refer to FIG. 3), it is more effective to provide the diode Df between the vicinity of the electronic open/close switch 15*a* inserted in the bus bar 13 and the bus bar 12 which is the other bus bar so that it is reverse-biased.

Figure 8:
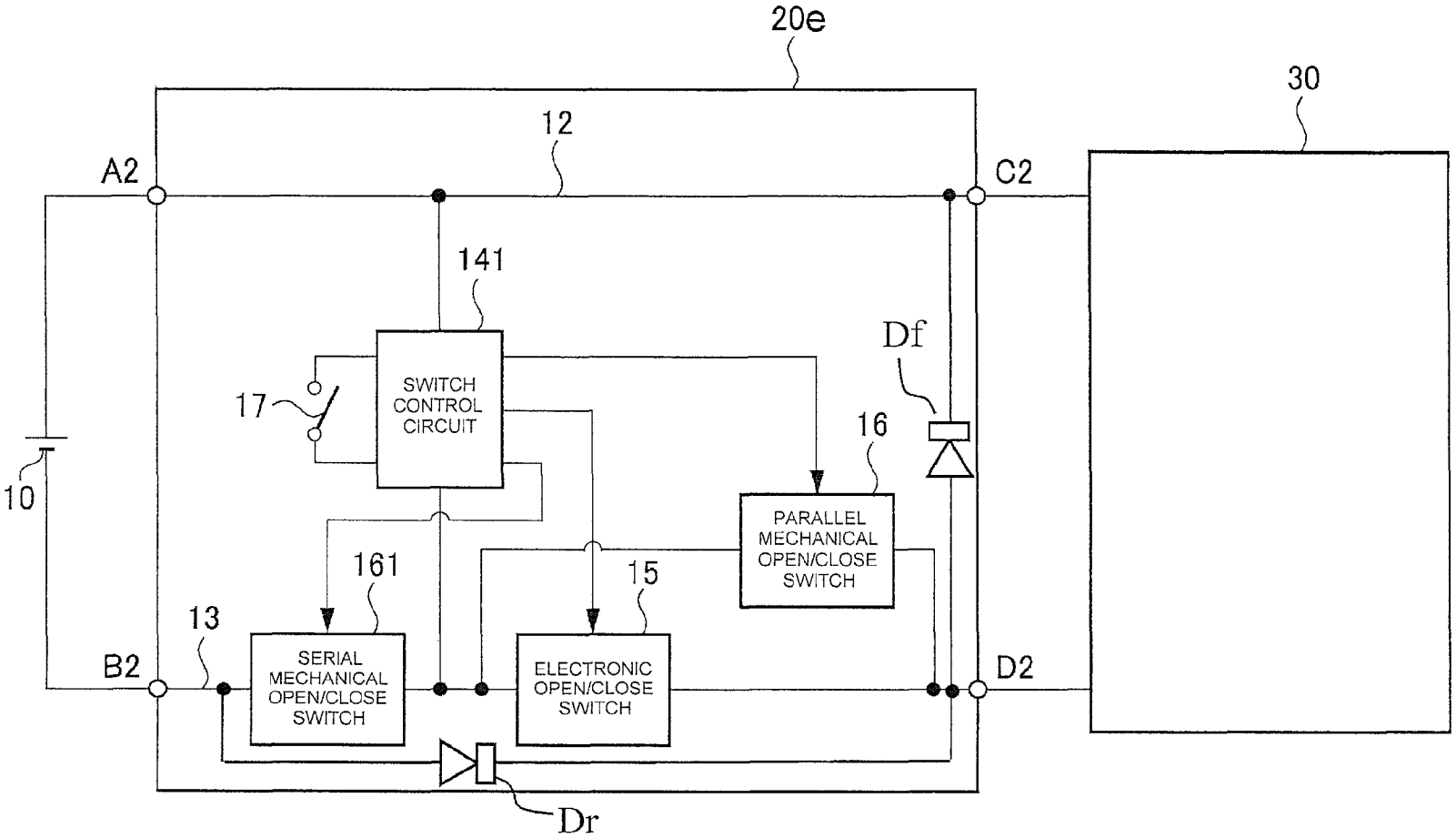
FIG. 8 is a diagram showing a second modification example of a direct-current switch.

FIG. 8 is a diagram showing a second modification example of a direct-current switch. A direct-current switch 20*e* in FIG. 8 is the direct-current switch 20*b* shown in FIG. 4 with a diode Df that functions as a commutating diode and a diode Dr that functions as a regenerative diode being connected thereto. The diode Dr is connected between the input terminal B2 and the output terminal D2 so that it is reverse-biased. Also, the diode Df is connected between the output terminal C2 and the output terminal D2 so that it is reverse-biased.

By employing the aforementioned configuration, a forward current is caused to flow through the diode Df immediately after the direct-current path of the load 30 having inductance has been opened, the generation of the counter electromotive force is prevented, and it is possible to prevent the direct-current switch 20*e* from being destroyed. Also, by causing a forward current to flow through the diode Dr, it is possible to regenerate the power generated from the load 30 to the utility grid.

Figure 9:
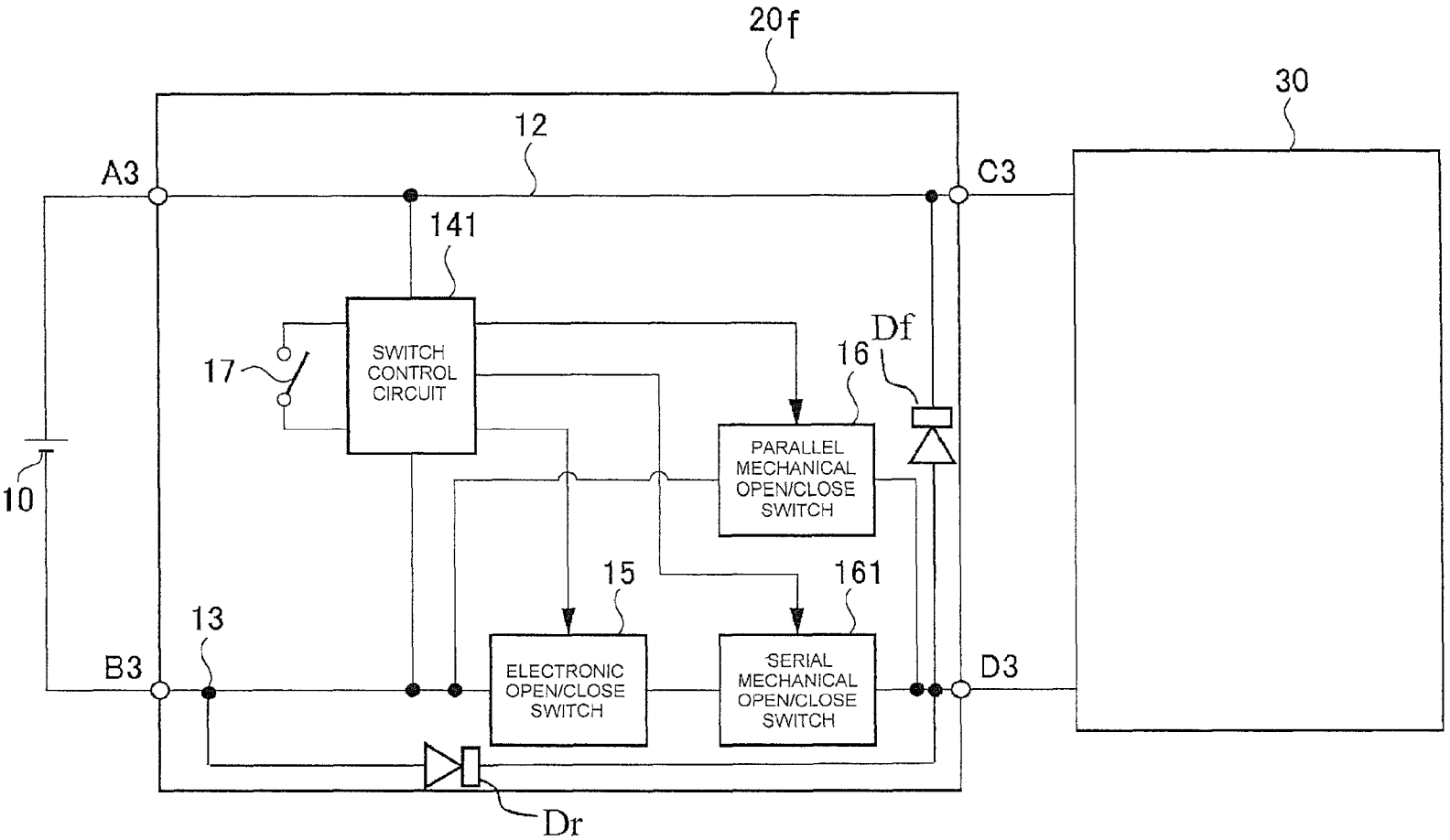
FIG. 9 is a diagram showing a third modification example of a direct-current switch.

FIG. 9 is a diagram showing a third modification example of a direct-current switch. A direct-current switch 20*f* in FIG. 9 is the direct-current switch 20*c* shown in FIG. 6 with a diode Df that functions as a commutating diode and a diode Dr that functions as a regenerative diode being connected thereto. The diode Dr is connected between the input terminal B3 and the output terminal D3 so that it is reverse-biased. Also, the diode Df is connected between the output terminal C3 and the output terminal D3 so that it is reverse-biased.

By employing the aforementioned configuration, a forward current is caused to flow through the diode Df immediately after the direct-current path of the load 30 having inductance has been opened, the generation of the counter electromotive force is prevented, and it is possible to prevent the direct-current switch 20*f* from being destroyed. Also, by causing a forward current to flow through the diode Dr, it is possible to regenerate the power generated from the load 30 to the utility grid.

Figure 10:
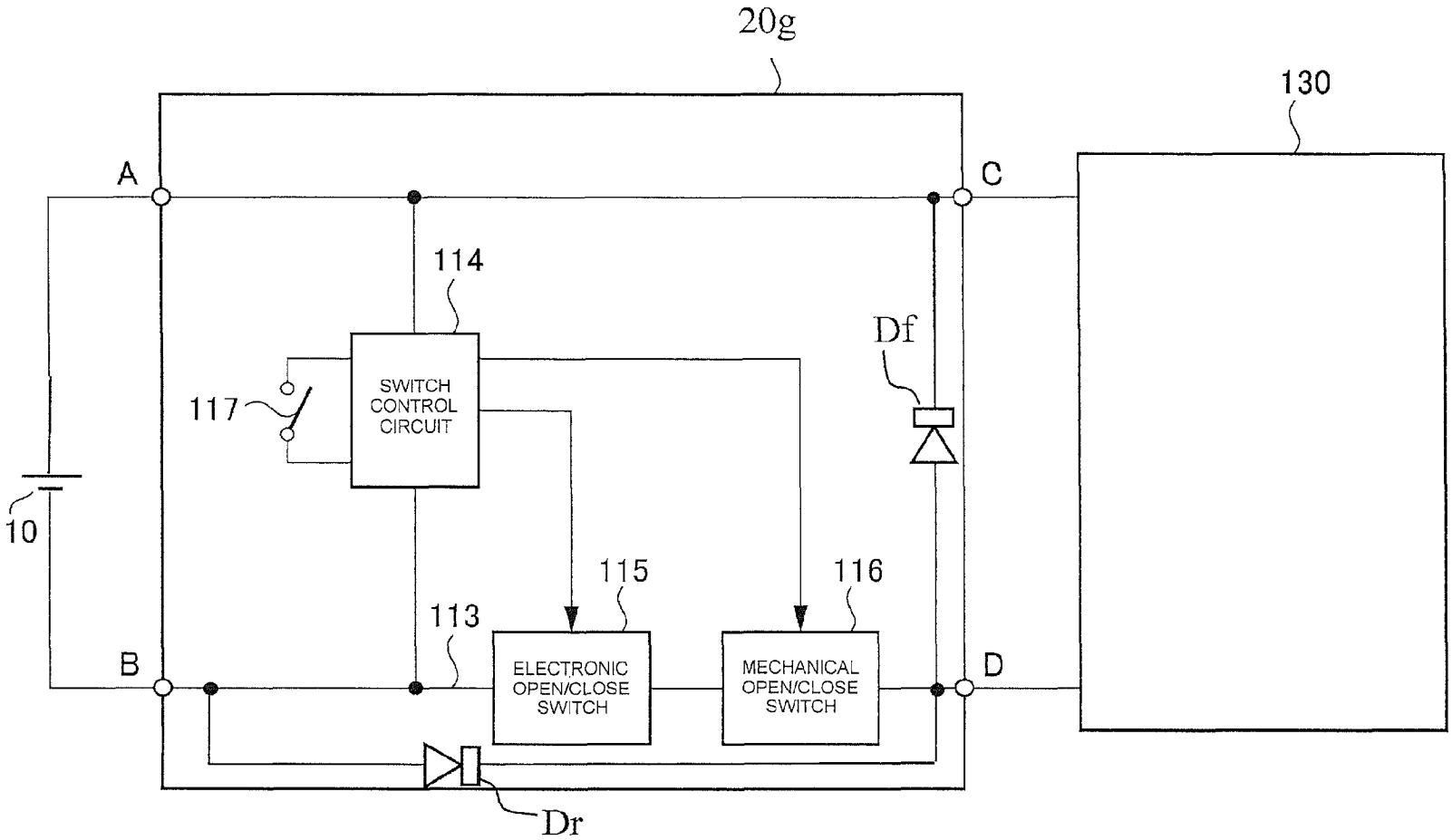
FIG. 10 is a diagram showing a fourth modification example of a direct-current switch.
Figure 14:
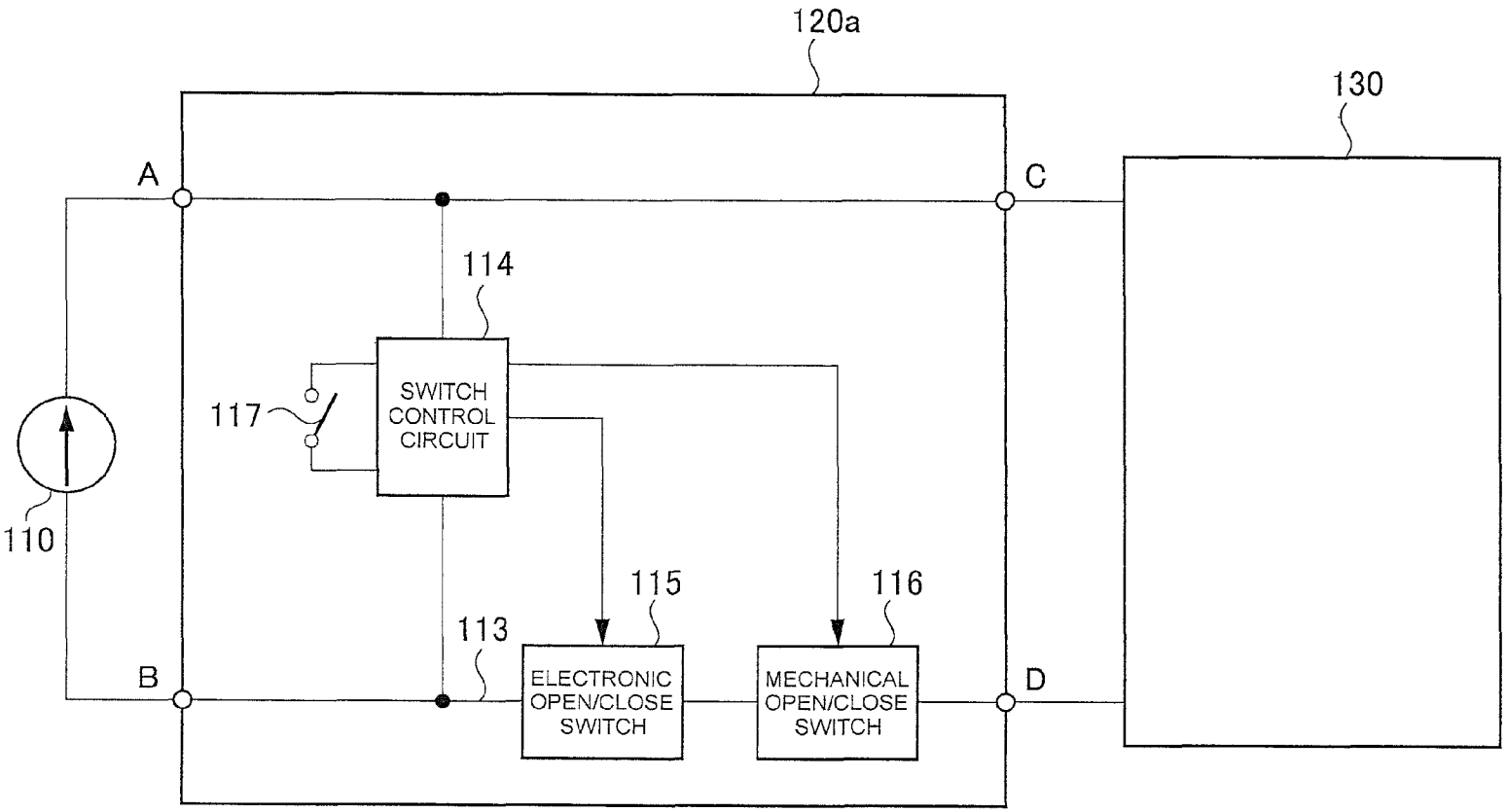
FIG. 14 is a diagram showing background art.

FIG. 10 is a diagram showing a fourth modification example of a direct-current switch. A direct-current switch 20*g* in FIG. 10 is the direct-current switch 120*a* shown in FIG. 14 with a diode Df that functions as a commutating diode and a diode Dr that functions as a regenerative diode being connected thereto. The diode Dr is connected between an input terminal B and an output terminal D so that it is reverse-biased. Also, the diode Df is connected between an output terminal C and an output terminal D so that it is reverse-biased.

In the direct-current switch 20*g*, a switch control circuit 114 makes an electronic open/close switch 115 a closed circuit after a serial mechanical open/close switch 116 has been made a closed circuit when making a direct-current path along which a direct current flows a closed circuit, and makes the serial mechanical open/close switch 116 an open circuit after the electronic open/close switch 115 has been made an open circuit when making the direct-current path along which a direct current flows an open circuit. By so doing, it is possible to prevent an arc discharge from occurring in the serial mechanical open/close switch 116.

By employing the aforementioned configuration, a forward current is caused to flow through the diode Df immediately after the direct-current path of a load 30 having inductance has been opened, the generation of the counter electromotive force is prevented, and it is possible to prevent the direct-current switch 20*g* from being destroyed. Also, by causing a forward current to flow through the diode Dr, it is possible to regenerate the power generated from the load 30 to the utility grid.

Figure 11:
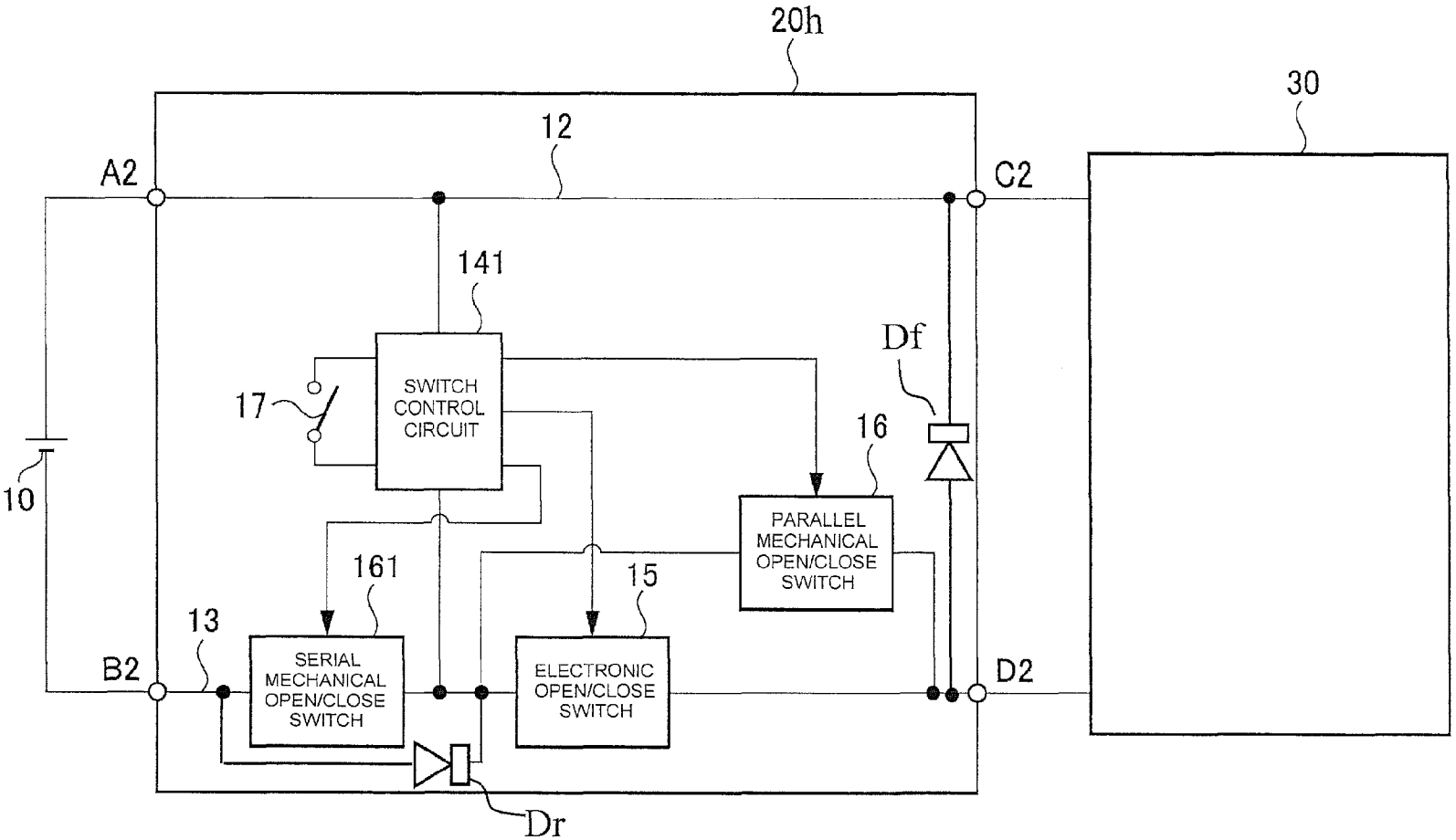
FIG. 11 is a diagram showing a fifth modification example of a direct-current switch.

FIG. 11 is a diagram showing a fifth modification example of a direct-current switch. A direct-current switch 20*h* in FIG. 11 is the direct-current switch 20*b* shown in FIG. 4 with a diode Df that functions as a commutating diode and a diode Dr that functions as a regenerative diode being connected thereto. The diode Or is connected in parallel to the serial mechanical open/close switch 161 so that it is reverse-biased. Also, the diode Df is connected between the output terminal C2 and the output terminal D2 so that it is reverse-biased.

By employing the aforementioned configuration, a forward current is caused to flow through the diode Df immediately after the direct-current path of the load 30 having inductance has been opened, the generation of the counter electromotive force is prevented, and it is possible to prevent the direct-current switch 20*h* from being destroyed. Also, by causing a forward current to flow through the diode Dr and the body diode of the electronic open/close switch 15, it is possible to regenerate the power generated from the load 30 to the utility grid.

Figure 12:
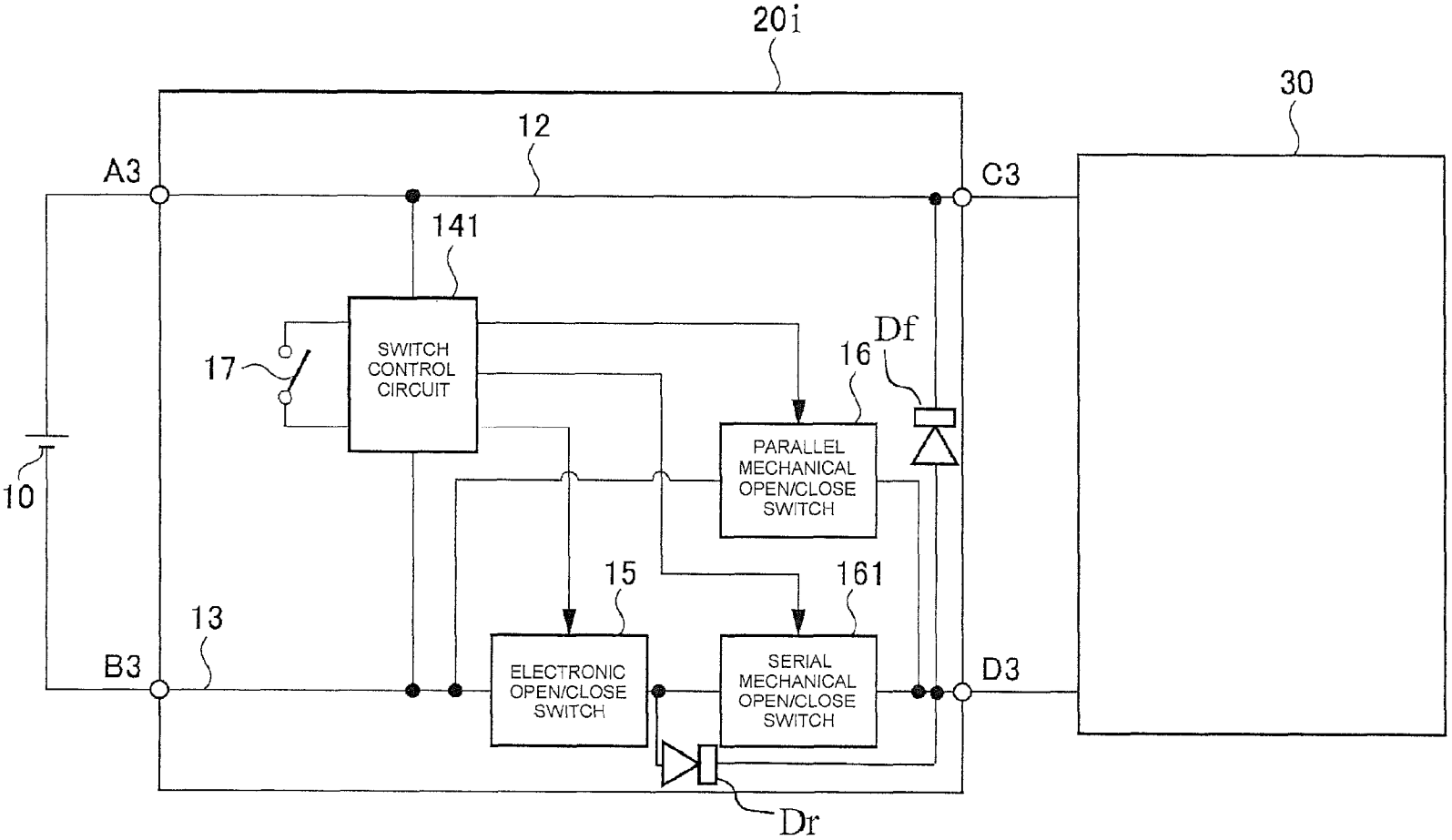
FIG. 12 is a diagram showing a sixth modification example of a direct-current switch.

FIG. 12 is a diagram showing a sixth modification example of a direct-current switch. A direct-current switch 20*i* in FIG. 12 is the direct-current switch 20*c* shown in FIG. 6 with a diode Df that functions as a commutating diode and a diode Dr that functions as a regenerative diode being connected thereto. The diode Dr is connected in parallel to the serial mechanical open/close switch 161 so that it is reverse-biased. Also, the diode Df is connected between the output terminal C3 and the output terminal D3 so that it is reverse-biased.

By employing the aforementioned configuration, a forward current is caused to flow through the diode Df immediately after the direct-current path of the load 30 having inductance has been opened, the generation of the counter electromotive force is prevented, and it is possible to prevent the direct-current switch 20*i* from being destroyed. Also, by causing a forward current to flow through the diode Dr and the body diode of the electronic open/close switch 15, it is possible to regenerate the power generated from the load 30 to the utility grid.

Figure 13:
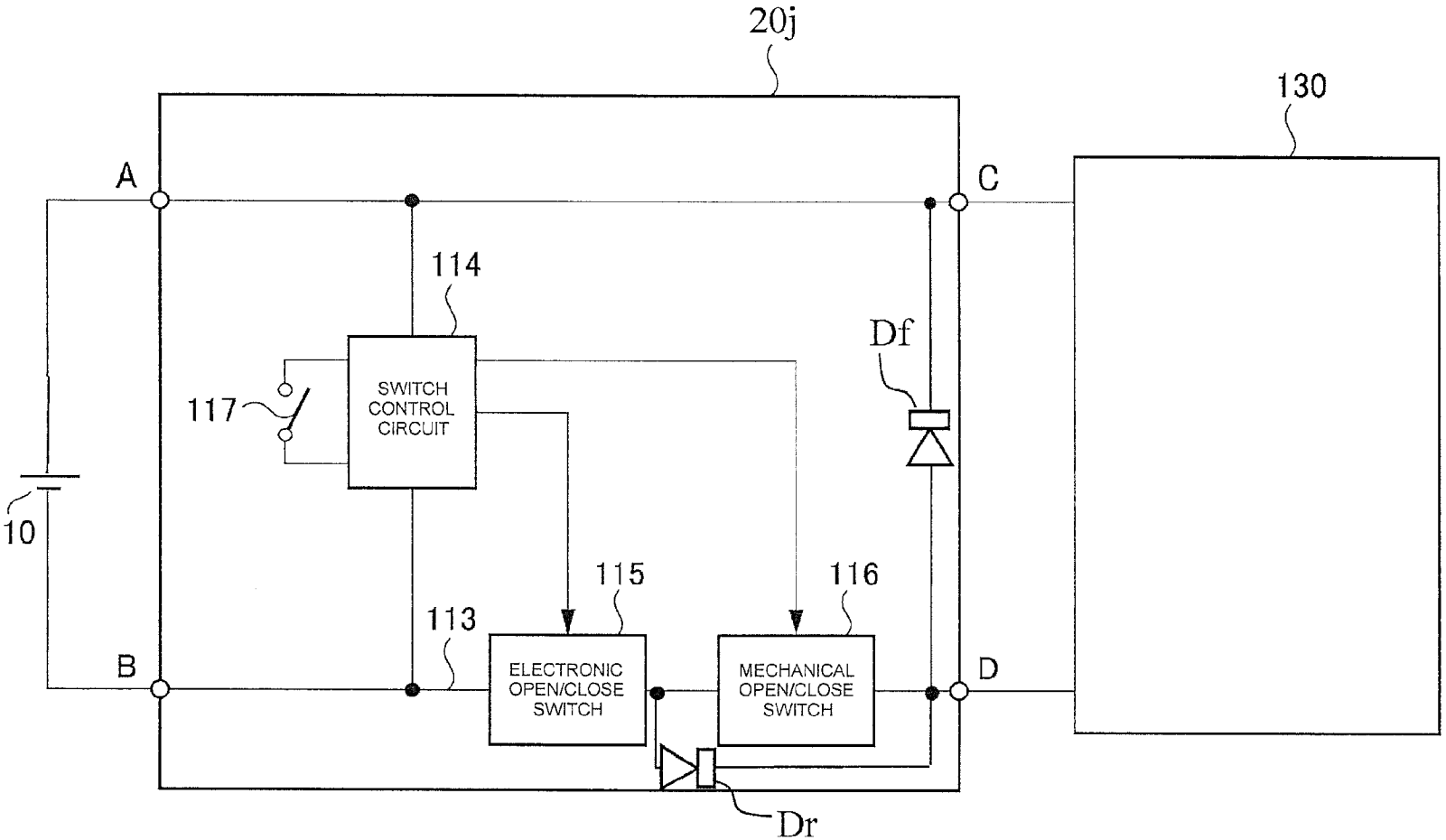
FIG. 13 is a diagram showing a seventh modification example of a direct-current switch.

FIG. 13 is a diagram showing a seventh modification example of a direct-current switch. A direct-current switch 20*j* in FIG. 13 is the direct-current switch 120*a* shown in FIG. 14 with a diode Df that functions as a commutating diode and a diode Dr that functions as a regenerative diode being connected thereto. The diode Dr is connected to the mechanical open/close switch (the serial mechanical open/close switch) 116 so that it is reverse-biased. Also, the diode Df is connected between the output terminal C and the output terminal D so that it is reverse-biased.

As shown in the direct-current switch 20*j*, the switch control circuit 114 makes the electronic open/close switch 115 a closed circuit after the serial mechanical open/close switch 116 has been made a closed circuit when making the direct-current path along which a direct current flows a closed circuit, and makes the serial mechanical open/close switch 116 an open circuit after the electronic open/close switch 115 has been made an open circuit when making the direct-current path along which a direct current flows an open circuit. By so doing, it is possible to prevent an arc discharge from occurring in the serial mechanical open/close switch 116.

Also, by employing the heretofore described configuration, a forward current is caused to flow through the diode Df immediately after the direct-current path of the load 30 having inductance has been opened, the generation of the counter electromotive force is prevented, and it is possible to prevent the direct-current switch 20*j* from being destroyed. Also, by causing a forward current to flow through the diode Dr and the body diode of the electronic open/close switch 115, it is possible to regenerate the power generated from the load 30 to the utility grid.

The heretofore described embodiment modification examples include the diode Df (the commutating diode) connected to the two output ends of the direct-current switch so that it is reverse-biased. Furthermore, the modification examples include the diode Dr (the regenerative diode) connected in parallel to the electronic open/close switch so that it is reverse-biased, the diode Dr (the regenerative diode) connected in parallel to the series connection circuit of the electronic open/close switch and serial mechanical open/close switch so that it is reverse-biased, or the diode Dr (the regenerative diode) connected in parallel to the mechanical open/close switch so that it is reverse-biased.

In the heretofore described embodiment modification examples, a description has been given assuming that both the diode Df that functions as a commutating diode and the diode Dr that functions as a regenerative diode are provided. However, when the load has an inductance component (for example, a wire inductance component from either end of the commutating diode to the load, or an inductance component of the load itself), it is possible to prevent the generation of the counter electromotive force occurring between the output terminals of the direct-current switch even when providing only the commutating diode. Also, with the load being a motor which generates electromotive force, it is possible to return regenerative power to the utility grid, even when providing only the regenerative diode.

When providing both the commutating diode and regenerative diode, it is possible to prevent the generation of the counter electromotive force occurring between the output terminals of the direct-current switch and/or return regenerative power to the utility grid with a still wider variety of loads when the load has an inductance component, including when the load is a motor, as heretofore described.

For example, when the load is a motor, the commutating diode and regenerative diode act with a time difference, as described below; immediately after the direct-current switch has been shut off, the counter electromotive force caused by a wire inductance component and the motor coil winding inductance component would be generated, but it is possible to prevent the generation of the counter electromotive force occurring with the commutating diode, and the motor is rotated by a forward current flowing through the commutating diode. Subsequently, when the forward current of the commutating diode is dissipated, the motor becomes a generator, the forward current flows through the regenerative diode, and it is possible to return regenerative power to the utility grid.

Aspects of Various Uses of Direct-Current Switch

The direct-current switch of any of the heretofore described embodiments can be used, configuring a plug inserted into an outlet connected to a utility grid, a load, and the direct-current switch as a unit, in the same way as a heretofore known switch built into an electrical appliance. Also, the direct-current switch can also be configured as an adaptor disposed as a separate device between a utility grid and a load.

When using the direct-current switch as an adaptor, a plug (not shown), the direct-current switch, and an outlet (not shown) are configured as an integrated part. A plug for inserting into an outlet provided in a utility grid is connected to an input terminal (for example, an input terminal A1) and an input terminal (for example, an input terminal B1), and an outlet of a form matching the plug is connected to an output terminal (for example, an output terminal C1) and an output terminal (for example, an output terminal D1). Then, a heretofore known type of electrical instrument is used as a load, the plug of the electrical instrument is inserted into the outlet of the adaptor, and a switch provided in the electrical instrument is in a normally closed condition. By turning the direct-current switch disposed inside the adaptor on or off (continuity/shut-off), it is possible to turn the heretofore known type of electrical instrument on or off (continuity/shut-off) safely and simply.

Herein, an electronic control is currently employed for most electrical instruments that operate on a heretofore known alternating-current system (for example, 100V single phase), and the aforementioned electrical instruments also operates on a direct-current system. Consequently, it is possible to operate the aforementioned electrical instruments by connecting to a direct-current system using an adaptor having a direct-current switch.

With an electrical instrument supplied with power via the aforementioned adaptor using a direct-current switch, it is possible to turn the power supply on and off safely, and with no arc being generated. Also, as it is possible to reduce the size of the direct-current switch inside the aforementioned adaptor, it is possible to reduce the size of the whole adaptor.

Modification Example of Direct-Current Switch Insertion Place

In the first embodiment to the third embodiment, and in the embodiment modification examples having a commutating diode and regenerative diode, a description has been given assuming that, in every case, the mechanical open/close switch and the electronic open/close switch are inserted between the input terminal B1 and the output terminal D1, between the input terminal B2 and the output terminal D2, between the input terminal B3 and the output terminal D3, and between the input terminal B and the output terminal D. However, it is also possible to achieve the desired effect by inserting the mechanical open/close switch, the electronic open/close switch, and the regenerative diode between the input terminal A1 and the output terminal C1, between the input terminal A2 and the output terminal C2, between the input terminal A3 and the output terminal C3, and between the input terminal A and the output terminal C. That is, it is possible to obtain the same effect by inserting the serial mechanical open/close switch and/or parallel mechanical open/close switch, the electronic open/close switch, and the regenerative diode either on the bus bar 12 or the bus bar 13 sides.

A new embodiment wherein individual technologies disclosed in the various embodiments are combined can also be implemented. Also, the invention is not limited to the range of the heretofore described embodiments and embodiments in which they are combined.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A direct-current switch, comprising:

an electronic open/close switch inserted in a direct-current path along which a direct current flows in order to make the direct-current path an open circuit or a closed circuit;

a parallel mechanical open/close switch connected in parallel to the electronic open/close switch;

a serial mechanical open/close switch connected in series to the electronic open/close switch;

a switch control circuit that controls the opening or closing time difference mutually among the parallel mechanical open/close switch, the electronic open/close switch, and the serial mechanical open/close switch; and a regenerative diode connected in parallel to the serial mechanical open/close switch so as to be reverse-biased, wherein when making the direct-current path a closed circuit, the switch control circuit:

makes the serial mechanical open/close switch a closed circuit, makes the electronic open/close switch a closed circuit after a predetermined time longer than a time needed for chattering of the serial mechanical open/close switch to abate, maintains the serial mechanical open/close switch closed during all a time in which the electronic open/close switch is closed, makes the parallel mechanical open/close switch a closed circuit after the electronic open/close switch has been made a closed circuit, and maintains the electronic open/close switch closed during all a time in which the parallel mechanical open/close switch is closed, and when making the direct-current path an open circuit, the switch control circuit:

makes the parallel mechanical open/close switch an open circuit, makes the electronic open/close switch an open circuit within a time longer than a time needed for chattering of the parallel mechanical open/close switch to abate, and within a time shorter than a time taken for the temperature of the electronic open/close switch to rise to a predetermined temperature, and makes the serial mechanical open/close switch an open circuit after the electronic open/close switch has been made an open circuit.

2. The direct-current switch according to claim 1, further comprising:

a commutating diode connected to ends of both output terminals of the direct-current switch so as to be reverse-biased.

3. A direct-current switch, comprising:

an electronic open/close switch to make a direct-current path along which a direct current flows an open circuit or a closed circuit;

a parallel mechanical open/close switch connected in parallel to the electronic open/close switch;

a serial mechanical open/close switch connected in series to the electronic open/close switch;

a switch control circuit that controls the opening or closing time difference mutually among the parallel mechanical open/close switch, the serial mechanical open/close switch, and the electronic open/close switch; and a regenerative diode connected in parallel to a series connection circuit of the electronic open/close switch and the serial mechanical open/close switch so as to be reverse-biased, wherein when making the direct-current path a closed circuit, the switch control circuit:

makes the serial mechanical open/close switch a closed circuit, makes the electronic open/close switch a closed circuit after a predetermined time longer than a time needed for chattering of the serial mechanical open/close switch to abate, and makes the parallel mechanical open/close switch a closed circuit after the electronic open/close switch has been made a closed circuit, and when making the direct-current path an open circuit, the switch control circuit:

makes the parallel mechanical open/close switch an open circuit, makes the electronic open/close switch an open circuit within a time longer than a time needed for chattering of the parallel mechanical open/close switch to abate, and within a time shorter than a time taken for the temperature of the electronic open/close switch to rise to a predetermined temperature, and makes the serial mechanical open/close switch an open circuit after the electronic open/close switch has been made an open circuit.

* * * * *